US008308259B2

(12) United States Patent
Seto

(10) Patent No.: US 8,308,259 B2
(45) Date of Patent: Nov. 13, 2012

(54) DRIVING DEVICE FOR LIQUID DROPLET JETTING DEVICE, LIQUID DROPLET JETTING DEVICE, IMAGE FORMING APPARATUS, AND COMPUTER READABLE MEDIUM

(75) Inventor: Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 316 days.

(21) Appl. No.: 12/776,554

(22) Filed: May 10, 2010

(65) Prior Publication Data

US 2011/0134174 A1 Jun. 9, 2011

(30) Foreign Application Priority Data

Dec. 8, 2009 (JP) ..... 2009-278981

(51) Int. Cl.
*B41J 29/38* (2006.01)

(52) U.S. Cl. ..... 347/10; 347/12; 347/13

(58) Field of Classification Search ..... 347/5, 9, 347/10, 11, 12, 13
See application file for complete search history.

(56) References Cited

FOREIGN PATENT DOCUMENTS

| | | |
|---|---|---|
| JP | 55-003916 | 1/1980 |
| JP | 08-048034 | 2/1996 |
| JP | 2004-268307 | 9/2004 |
| JP | 2004-358701 | 12/2004 |
| JP | 2009-208445 | 9/2009 |

OTHER PUBLICATIONS

The Imaging Society of Japan, Shinji Seto, Tohinobu Hamazaki, Directionality Modulation Technology on Piezoelectric Ink Jet, pp. 209-212 of The 103rd Annual Conference of the Imaging Society of Japan, Jun. 10, 2009.

The Imaging Society of Japan, Shinji Seto, Tohinobu Hamazaki, Directionality Modulation Technology on Piezoelectric Ink Jet, The 103rd Annual Conference of the Imaging Society of Japan, Jun. 12, 2009, Kokuyo Hall 1-8-35 Konan Minato-ku Tokyo Japan.

*Primary Examiner* — Lam S Nguyen
(74) *Attorney, Agent, or Firm* — Fildes & Outland, P.C.

(57) ABSTRACT

A driving device for a liquid jetting apparatus includes an application unit and a controller. The application unit generates and applies a first voltage of a first waveform to a first pressure generating unit and generates and applies a second voltage of a second waveform to the second pressure generating unit to jet a liquid droplet outside a nozzle after pulling liquid inside the nozzle. The second waveform includes at least one of a third waveform corresponding to a jetting angle for changing a jetting direction from a reference direction by deforming a liquid level of liquid pulled inside the nozzle in a direction of pushing the liquid level outside the nozzle, or a fourth waveform corresponding to a jetting angle for changing the jetting direction from the reference direction by deforming the liquid level of liquid pulled inside the nozzle in a direction of further pulling the liquid level.

16 Claims, 25 Drawing Sheets

FIG.9

| | JETTING WAVEFORM | DROPLET SPEED (m/s) | MODULATION VOLTAGE (V) |
|---|---|---|---|
| CONDITION 1 | PULL-HIT | 10 | 0～5 |
| CONDITION 2 | PULL-HIT | 3～10 | 5 |
| CONDITION 3 | PUSH-HIT | 3～10 | 5 |

FIG.12

| | DROPLET SPEED (m/s) | DRIVING WAVEFORM DRIVING VOLTAGE (V) | MODULATION WAVEFORM MODULATION VOLTAGE (V) |
|---|---|---|---|
| CONDITION 4 | 5 | 10 | 10 |

FIG.14

| | MODULATION WAVEFORM | DROPLET SPEED (m/s) | PHASE DIFFERENCE (us) | MODULATION VOLTAGE (V) |
|---|---|---|---|---|
| CONDITION 5 | PUSH-HIT | 3～10 | -5～3 | 5 |

FIG.17

| | MODULATION WAVEFORM | DROPLET SPEED (m/s) | PHASE DIFFERENCE (us) | MODULATION VOLTAGE (V) |
|---|---|---|---|---|
| CONDITION 6 | PULL-HIT | 10 | -5～5 | 5 |

FIG.19

| LEVEL | JETTING ANGLE (mrad) | MODULATION VOLTAGE Vc (V) |
|---|---|---|
| 1 | 0 | 0 |
| 2 | 10 | 0.6 |
| 3 | 20 | 1.3 |
| 4 | 30 | 2.1 |
| 5 | 40 | 2.8 |
| 6 | 50 | 3.5 |

FIG.21

| LEVEL | JETTING ANGLE (mrad) | PHASE DIFFERENCE tc (us) | MODULATION VOLTAGE Vc (V) |
|---|---|---|---|
| 1 | 0 | - | 0 |
| 2 | 10 | -0.6 | 5 |
| 3 | 20 | 0 | 5 |
| 4 | 30 | 0.5 | 5 |
| 5 | 40 | 0.8 | 5 |
| 6 | 50 | 1.3 | 5 |
| 7 | 60 | 1.7 | 5 |

FIG.23

| LEVEL | JETTING ANGLE (mrad) | PHASE DIFFERENCE tc (us) | MODULATION VOLTAGE Vc (V) |
|---|---|---|---|
| 1 | 30 | 1.7 | 5 |
| 2 | 0 | 0 | - |
| 3 | -30 | 0.5 | 5 |

FIG.25

| LEVEL | JETTING ANGLE (mrad) | PHASE DIFFERENCE tc (us) | MODULATION VOLTAGE Vc (V) |
|---|---|---|---|
| 1 | 30 | 2 | 2.1 |
| 2 | 20 | 0 | 5 |
| 3 | 0 | - | - |
| 4 | 10 | -0.6 | 5 |
| 5 | -10 | 0 | 2.1 |

DRIVING DEVICE FOR LIQUID DROPLET JETTING DEVICE, LIQUID DROPLET JETTING DEVICE, IMAGE FORMING APPARATUS, AND COMPUTER READABLE MEDIUM

CROSS-REFERENCE TO RELATED APPLICATIONS

This application is based on and claims priority under 35 USC 119 from Japanese Patent Application No. 2009-278981 filed Dec. 8, 2009.

BACKGROUND

Technical Field

The present invention relates to a driving device for a liquid droplet jetting device, a liquid droplet jetting device, an image forming apparatus, and a computer readable medium storing a driving program of a liquid droplet jetting device.

SUMMARY

According to an aspect of the invention, there is provided a driving device for a liquid droplet jetting device, the liquid droplet jetting device including a plurality of pressure chambers which includes first and second pressure chambers disposed along a predetermined direction with respect to a nozzle from which a liquid droplet is jetted, a first pressure generating unit provided corresponding to the first pressure chamber, and a second pressure generating unit provided corresponding to the second pressure chamber, the first pressure generating unit generating pressure for jetting a liquid droplet outside the nozzle after pulling the liquid inside the nozzle when a first voltage of a predetermined first waveform for jetting the liquid droplet outside the nozzle after pulling the liquid inside the nozzle is applied, the second pressure generating unit generating pressure for deforming a liquid level of the liquid pulled inside the nozzle by applying the first voltage when a second voltage of a second waveform, whose voltage value is smaller than that of the first waveform, for deforming the liquid level of the liquid pulled inside the nozzle by applying the first voltage to the first pressure generating unit is applied, the driving device including: an application unit that generates the first voltage of the first waveform and applies the first voltage of the first waveform to the first pressure generating unit and that generates the second voltage of the second waveform and applies the second voltage of the second waveform to the second pressure generating unit; and a controller that controls the application unit to generate a waveform which includes at least one of a third waveform or a fourth waveform as the second waveform and to apply the waveform to the second pressure generating unit, the third waveform being set in advance according to a jetting angle from a reference jetting direction in order to change a liquid droplet jetting direction from the reference jetting direction to the predetermined direction by deforming the liquid level of liquid pulled inside the nozzle in a direction of pushing the liquid level outside the nozzle, and the fourth waveform being set in advance according to a jetting angle from the reference jetting direction in order to change the liquid droplet jetting direction from the reference jetting direction to the predetermined direction by deforming the liquid level of liquid pulled inside the nozzle in a direction of further pulling the liquid level inside the nozzle.

BRIEF DESCRIPTION OF THE DRAWINGS

Exemplary embodiments of the present invention will be described in detail based on the following figures, wherein:

FIG. 9 is a view showing a specific example of the driving conditions of a piezoelectric element in the present exemplary embodiment;

FIG. 12 is a view showing a specific example of the driving condition when piezoelectric elements are driven on the basis of the specific example shown in FIG. 11;

FIG. 14 is a view showing a specific example of the driving condition of the specific example shown in FIG. 13 in the present exemplary embodiment;

FIG. 17 is a view showing a specific example of the driving condition of the specific example shown in FIG. 16 in the present exemplary embodiment;

FIG. 19 is a view showing a specific example of the driving conditions (levels) in a first example;

FIG. 21 is a view showing a specific example of the driving conditions (levels) in a third example;

FIG. 23 is a view showing a specific example of the driving conditions (levels) in the fourth example;

FIG. 25 is a view showing a specific example of the driving conditions (levels) in the fifth example.

DETAILED DESCRIPTION

An exemplary embodiment of the invention will be described in detail with reference to the accompanying drawings.

Figure 1:
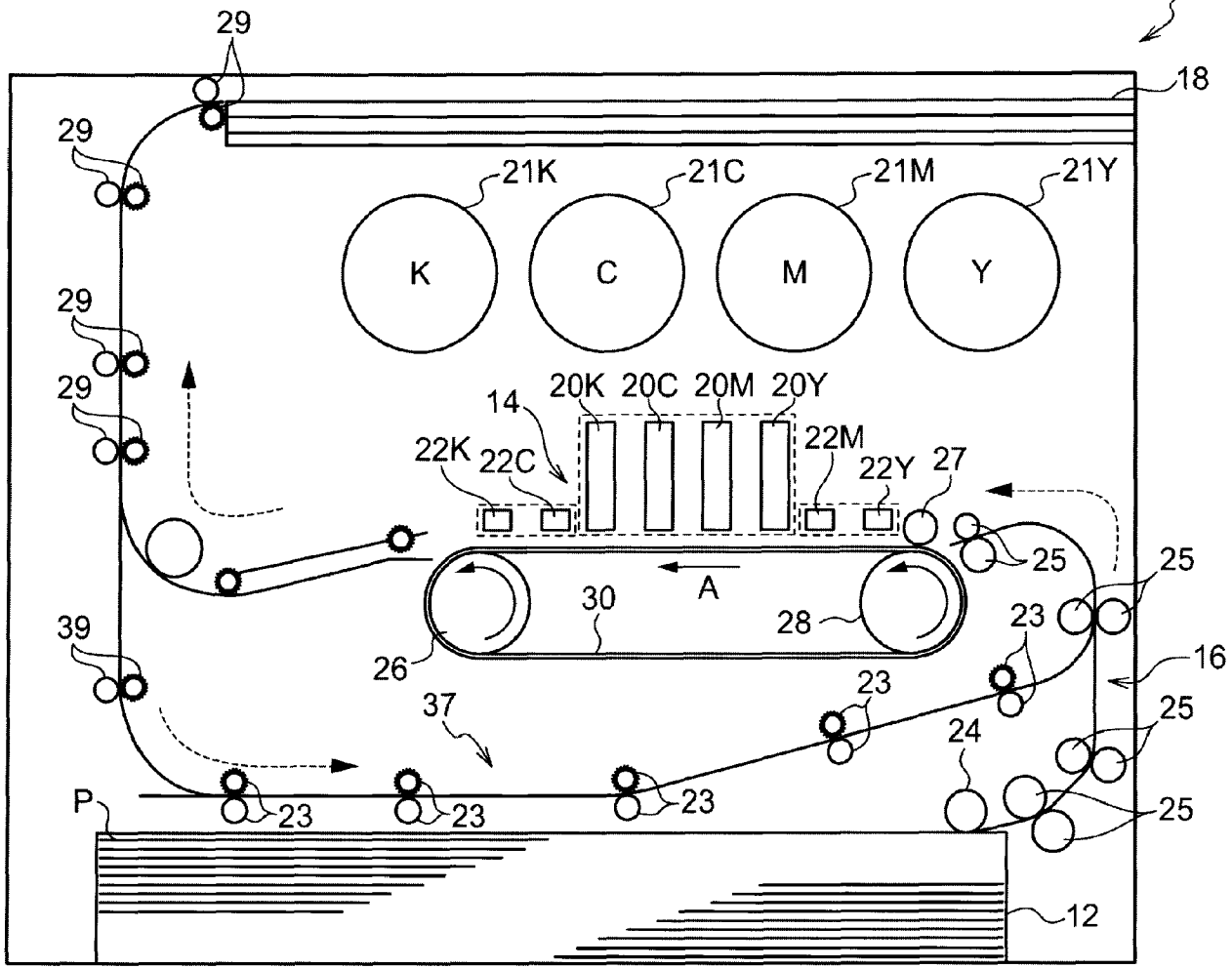
FIG. 1 is a schematic configuration view showing an example of the schematic configuration of an image forming apparatus according to an exemplary embodiment of the invention.
Figure 2:
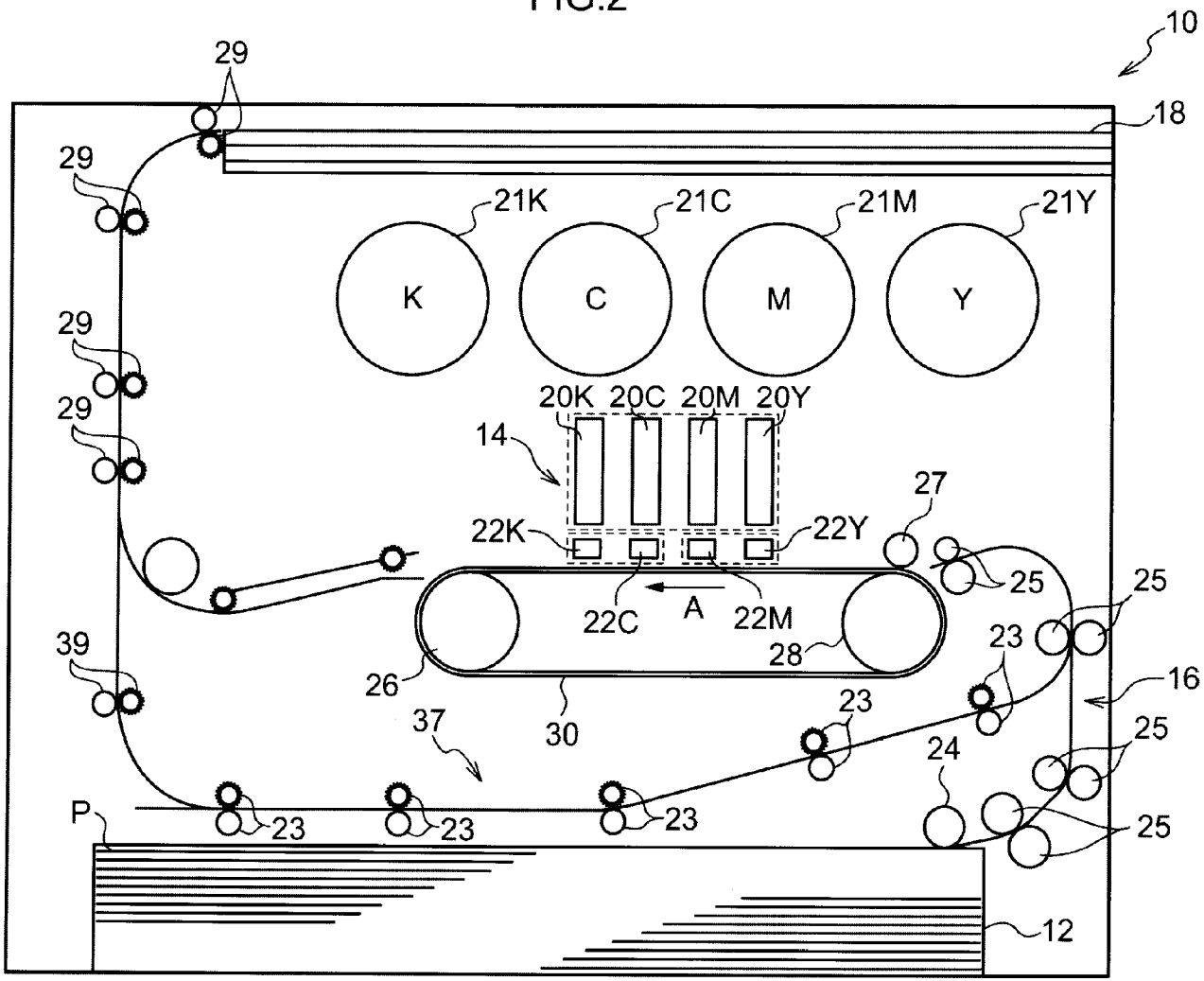
FIG. 2 is a schematic configuration view showing a specific example of the schematic configuration which shows a state where a maintenance unit in the image forming apparatus according to the exemplary embodiment of the invention is at the opposite position facing a nozzle surface of a liquid droplet jetting head.

The schematic configuration of the entire image forming apparatus according to the present exemplary embodiment will be described. FIGS. 1 and 2 are schematic configuration views showing the schematic configuration of an example of the image forming apparatus according to the present exemplary embodiment.

As shown in FIGS. 1 and 2, an image forming apparatus 10 includes: a recording medium receiving unit 12 in which a recording medium P, such as paper, is accommodated; an image forming unit 14 that forms an image on the recording medium P; a conveyor unit 16 that conveys the recording medium P from the recording medium receiving unit 12 to the image forming unit 14; and a recording medium exit unit 18 that exits the recording medium P on which an image is formed by the image forming unit 14.

The image forming unit 14 includes, as a specific example of a liquid droplet jetting head that jets an ink droplet as a liquid droplet, liquid droplet jetting heads 20Y, 20M, 20C, and 20K (hereinafter, collectively called liquid droplet jetting heads 20) that jet ink droplets from nozzles to form an image on a surface of a recording medium.

The liquid droplet jetting heads 20 are arrayed in parallel in order of colors of yellow (Y), magenta (M), cyan (C), and black (K) from the upstream side in the conveying direction of the recording medium P. Ink droplets corresponding to the respective colors are jetted from plural nozzles, which are formed on a nozzle surface, by a piezoelectric method to thereby form an image.

The liquid droplet jetting head 20 is formed to be longer in the width direction (main scanning direction) of the recording medium P than in the conveying direction (sub-scanning direction) of the recording medium P. The liquid droplet jetting head 20 is configured to form one line in the main scanning direction without moving in the main scanning direction relative to the recording medium P. Accordingly, the liquid droplet jetting head 20 moves in the sub-scanning direction relative to the recording medium P in order to form a color image. In addition, the width direction of the recording medium P is a direction crossing the conveying direction of the recording medium P.

Ink tanks 21Y, 21M, 21C, and 21K (hereinafter, collectively called ink tanks 21) that store ink are provided in the image forming apparatus 10 as liquid reservoirs that store liquid. Ink is supplied from the ink tanks 21 to each liquid droplet jetting head 20. In addition, various kinds of ink, such as water based ink, oil based ink, and solvent based ink, may be used as ink supplied to the liquid droplet jetting head 20.

In addition, maintenance units 22Y, 22M, 22C, and 22K (hereinafter, collectively called maintenance units 22) that perform maintenance of the liquid droplet jetting head 20 are provided in the image forming apparatus 10. The maintenance units 22 are configured to move between the facing position (see FIG. 2) which the maintenance units 22 face the nozzle surface of the liquid droplet jetting head 20, and the retreat position (see FIG. 1) the maintenance units 22 retreat from the nozzle surface of the liquid droplet jetting head 20.

Each maintenance unit 22 has a cap that covers the nozzle surface of the liquid droplet jetting head 20, a receiving member that receives liquid droplets which are preliminarily jetted (idle jetting), a cleaning member that cleans the nozzle surface of the liquid droplet jetting head 20, a suction unit for sucking ink in the nozzle, and the like. When performing maintenance of each liquid droplet jetting head 20, each liquid droplet jetting head 20 moves up to a height set in advance and the maintenance unit 22 moves to the facing position. Then, various kinds of maintenance are performed.

The conveyor unit 16 includes: a delivery roller 24 that delivers the recording medium P received in the recording medium receiving unit 12; a conveyor roller pair 25 which conveys the recording medium P delivered by the delivery roller 24; and an endless conveyor belt 30 that makes the recording surface of the recording medium P conveyed by the conveyor roller pair 25 face the liquid droplet jetting head 20.

The conveyor belt 30 is wound around a driving roller 26, which is disposed at the downstream side in the conveying direction of the recording medium P, and a driven roller 28, which is disposed at the upstream side in the conveying direction of the recording medium P, and circulates in a direction (A direction in FIG. 1) set in advance.

In addition, the conveyor belt 30 may be a conveying body that conveys the recording medium P, or may be a conveying drum or the like as an example of a conveying body that conveys the recording medium P in a state where the recording medium P is placed on the outer peripheral surface thereof, for example.

A pressure roller 27 that presses the recording medium P to the conveyor belt 30 is provided above the driven roller 28. The pressure roller 27 is driven by the conveyor belt 30 and also serves as a charging roller. Since the conveyor belt 30 is charged by the pressure roller 27, the recording medium P is conveyed in a state of being electrostatically adsorbed on the conveyor belt 30.

By conveying the recording medium P by the conveyor belt 30, the liquid droplet jetting head 20 and the recording medium P move relative to each other. By the jetting of an ink droplet onto the recording medium P moving relative to the liquid droplet jetting head 20, an image is formed.

In addition, a configuration may be adopted in which the liquid droplet jetting head 20 moves with respect to the recording medium P, or a configuration may be adopted in which the recording medium P and the liquid droplet jetting head 20 move relative to each other.

The conveyor belt 30 is not limited to a configuration of holding the recording medium P by electrostatic adsorption. For example, the recording medium P may be held by friction between the conveyor belt 30 and the recording medium P or by a non-electrostatic means such as attraction and adherence.

A separating claw (not shown) for separating the recording medium P from the conveyor belt 30 is provided at the downstream side of the conveyor belt 30 so as to become close to or far from the conveyor belt 30. The recording medium P on which an image is formed by the liquid droplet jetting head 20 is separated from the conveyor belt 30 with the curvature and the separating claw of the conveyor belt 30.

Plural conveyor roller pairs 29 having star wheels at the recording surface side of the recording medium P are provided at the downstream side of the separating claw. The recording medium P on which an image is formed by the image forming unit 14 is conveyed to the recording medium exit unit 18 by the conveyor roller pairs 29.

An inversion unit 37 that inverts the recording medium P is provided below the conveyor belt 30. After the recording medium P is conveyed to the downstream side by the conveyor roller pairs 29, the conveyor roller pairs 29 rotate inversely to convey the recording medium P to the inversion unit 37.

Plural conveyor roller pairs 23 having star wheels at the recording surface side of the recording medium P are provided in the inversion unit 37. The recording medium P conveyed to the inversion unit 37 is conveyed to the conveyor belt 30 again.

Although not shown, the image forming apparatus 10 includes: a head controller that determines a jetting timing of an ink droplet and a nozzle of the liquid droplet jetting head 20 to be used according to image data; and a system controller that controls an operation of the entire image forming apparatus 10.

An image recording operation of the image forming apparatus 10 will be described.

By the delivery roller 24, the recording medium P is delivered from the recording medium receiving unit 12. The recording medium P is delivered to the conveyor belt 30 by the conveyor roller pairs 25 located at the side further upstream than the conveyor belt 30.

The recording medium P delivered to the conveyor belt 30 is adsorbed and held on the conveying surface of the conveyor belt 30 and is then conveyed to the recording position of the liquid droplet jetting head 20, such that an image is formed on the recording surface of the recording medium P. After the image formation is complete, the recording medium P is separated from the conveyor belt 30 by the separating claw.

In the case of forming an image on one surface of the recording medium P, the recording medium P exits to the recording medium exit unit 18 by the conveyor roller pairs 29 located at the side further downstream than the conveyor belt 30.

In the case of forming images on both surfaces of the recording medium P, the recording medium P is inverted by the inversion unit 37 after an image is formed on one surface of the recording medium P, and the recording medium P is delivered again to the conveyor belt 30. An image is formed on the opposite surface of the recording medium P as described above. As a result, images are formed on both surfaces of the recording medium P, and the recording medium P exits to the recording medium exit unit 18.

Figure 3:
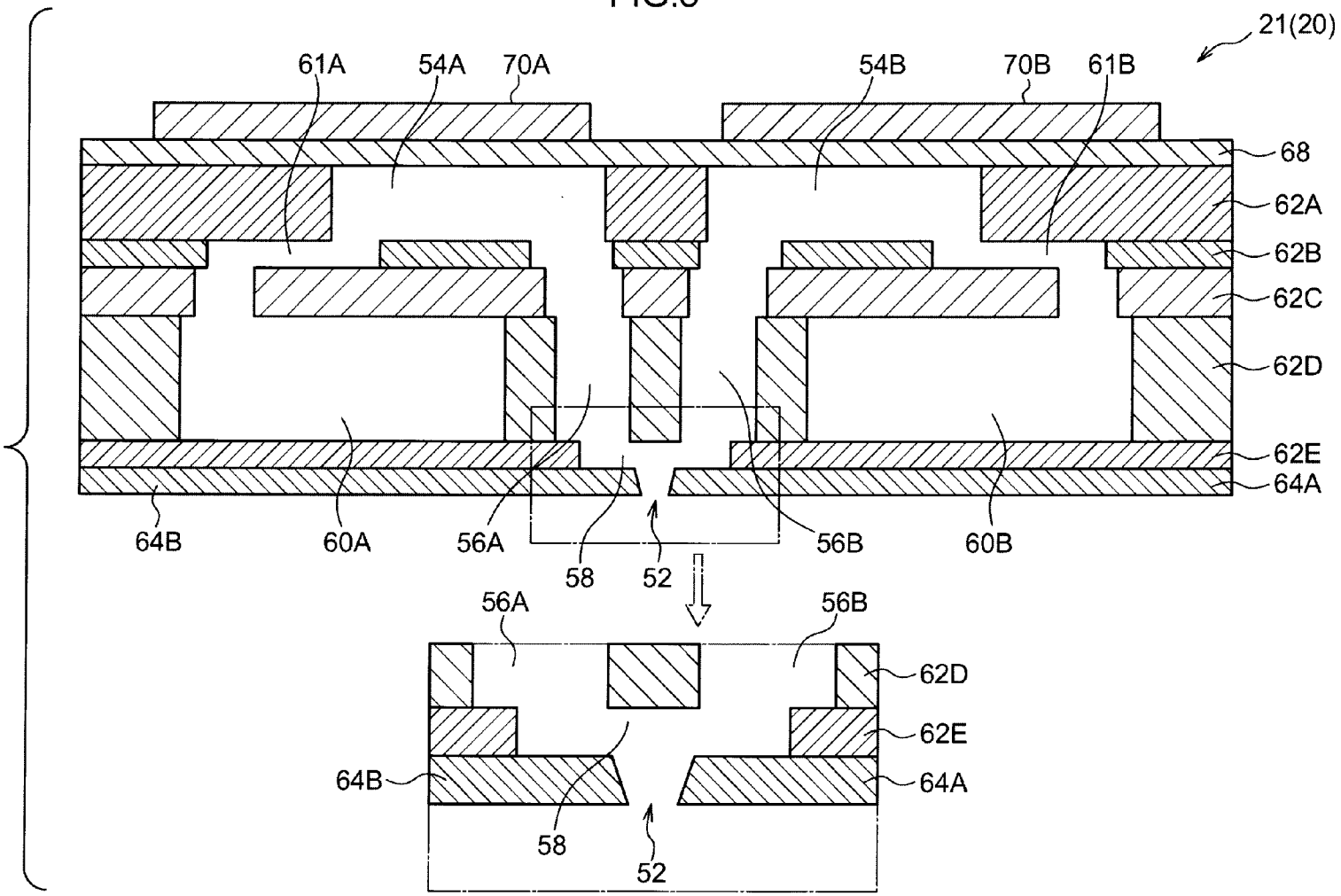
FIG. 3 is a schematic sectional view showing main components in a specific example of the configuration of a liquid droplet jetting head in the present exemplary embodiment.

The schematic configuration of the liquid droplet jetting head 20 in the present exemplary embodiment will be described. FIG. 3 is a schematic sectional view showing main components in a configuration of an ejector 21 of the liquid droplet jetting head in the present exemplary embodiment. The liquid droplet jetting head 20 in the present exemplary embodiment has plural nozzles. Two pressure chambers 54 are disposed for each nozzle. The configuration of pressure chambers with respect to one nozzle is shown in FIG. 3.

As shown in FIG. 3, one ejector 21 is configured to include two pressure chambers 54A and 54B. The two pressure chambers 54A and 54B communicate with one nozzle 52. Ink flows from the two pressure chambers 54A and 54B to one nozzle 52.

On the pressure chamber 54A and 54B, piezoelectric elements 70A and 70B are disposed as a specific example of a pressure generating unit that generates the pressure for jetting an ink droplet from the nozzle 52. In addition, it is may also adopt a configuration in which three or more pressure chambers 54 and three or more piezoelectric elements 70 are disposed for one nozzle 52.

As a specific example, the liquid droplet jetting head 20 in the present exemplary embodiment is formed by laminating and bonding plural etching plates of SUS (etching stainless steel) (etching plates 62A to 62E), as shown in FIG. 3. The nozzle 52 is formed using a laser-machined polyimide film 64.

The two pressure chambers 54A and 54B, which communicate with the nozzle 52 and in which ink is filled, communicate with flow passages 56A and 56B and a flow passage 58, respectively, so that ink flows from the pressure chambers 54A and 54B to the nozzle 52.

Common flow passages 60A and 60B are provided for the two pressure chambers 54A and 54B, respectively. Ink is supplied from the common flow passages 60A and 60B to the pressure chambers 54A and 54B through the flow passages 61A and 61B. A diaphragm 68 formed on the etching plate 62A forms upper walls of the pressure chambers 54A and 54B by closing upper openings of the pressure chambers 54A and 54B. Thus, the diaphragm 68 forms a part of the pressure chamber 54.

A jetting voltage Vm (hereinafter, simply called a "jetting waveform"; will be described in detail later) expressed by a jetting waveform is applied to the piezoelectric element 70A laminated on the diaphragm 68. In addition, a modulation voltage Vc (hereinafter, simply called a "modulation waveform"; will be described in detail later) expressed by a modulation waveform is applied to the piezoelectric element 70B. The piezoelectric elements 70A and 70B are driven by application of the jetting waveform and the modulation waveform.

When a jetting waveform and a modulation waveform are applied to the piezoelectric elements 70A and 70B, the piezoelectric elements 70A and 70B displace the diaphragm 68 to change the volume in the pressure chamber 54 so that ink filled in the pressure chambers 54A and 54B is pressed. As a result, ink flows from the pressure chambers 54A and 54B to the nozzle 52 through the flow passages 56A and 56B and the flow passage 58, and an ink droplet is jetted from the nozzle 52.

Figure 4:
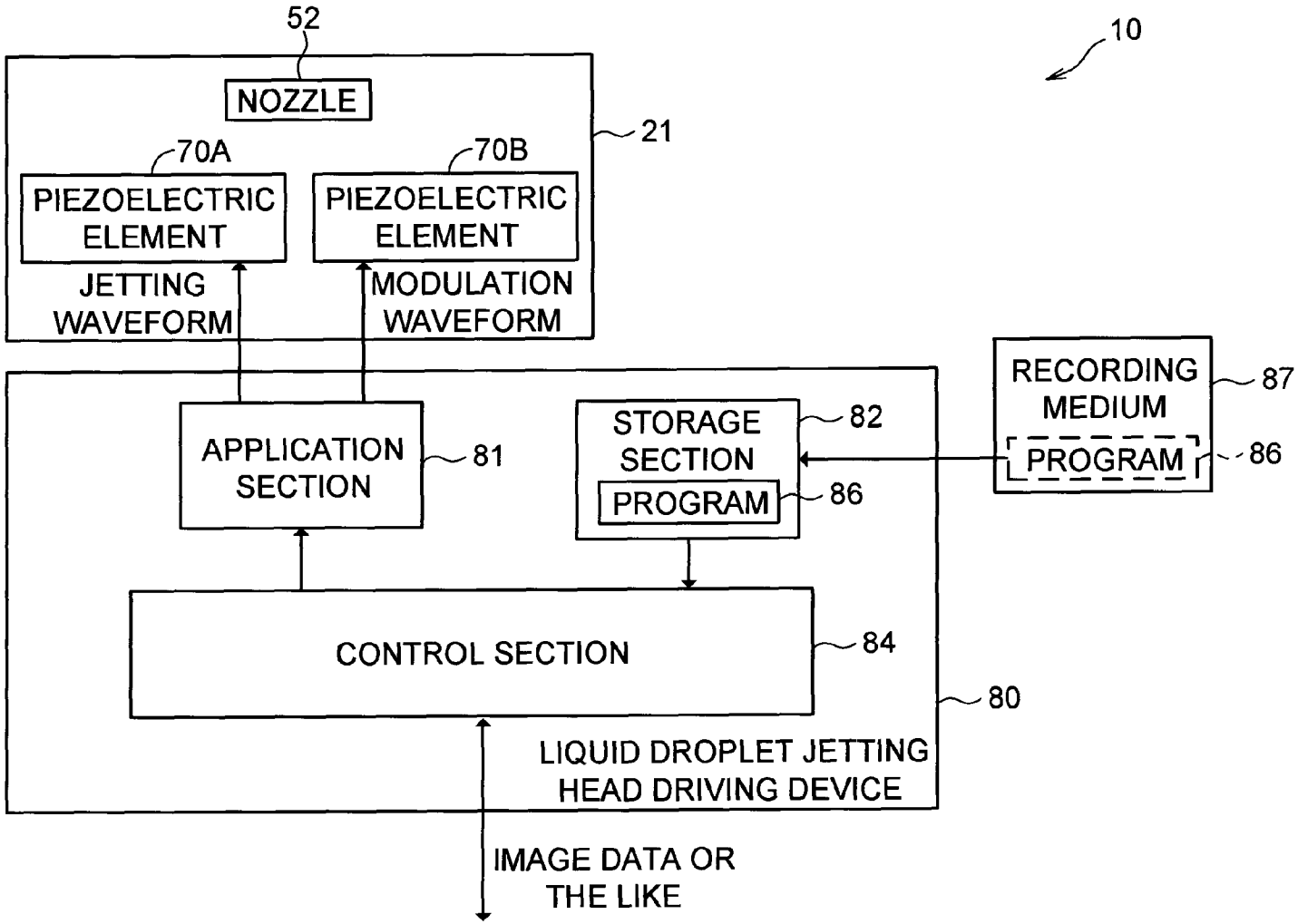
FIG. 4 is a functional block diagram showing a specific example of the schematic configuration of a liquid droplet jetting head driving device in the present exemplary embodiment.

A liquid droplet jetting head driving device for driving the liquid droplet jetting head 20 in the present exemplary embodiment will be described. FIG. 4 is a functional block diagram showing the schematic configuration of a specific example of a liquid droplet jetting head driving device 80 in the present exemplary embodiment. In FIG. 4, one of the plural ejectors 21 provided in the liquid droplet jetting head 20 is representatively shown.

As shown in FIG. 4, the liquid droplet jetting head driving device 80 in the present exemplary embodiment is configured to include an application section 81, a storage section 82, and a control section 84.

The control section 84 drives the liquid droplet jetting head 20 so that a liquid droplet is jetted from the nozzle 52 of the liquid droplet jetting head 20 according to the image data or the like. Specifically, the control section 84 controls the application section 81 to generate a jetting waveform, which is set in advance according to the image data, and apply the jetting waveform to the piezoelectric element 70A and also controls the application section 81 to generate a modulation waveform, which corresponds to the jetting angle of a liquid droplet jetted according to the image data or the like, and apply the modulation waveform to the piezoelectric element 70B.

In the present exemplary embodiment, a CPU (not shown) having a ROM and a RAM therein is provided as a specific example. By executing a program using the CPU, control of the application section 81 using the control section 84 is executed. A corresponding program 86 is stored in the storage section 82. Moreover, the program 86 may be stored in a ROM as a recording medium included in the control section 84 or may be recorded in a recording medium 87, such as a CD-ROM or a DVD-ROM, so that it is read and executed by the CPU in a state where it is installed in the liquid droplet jetting head driving device 80.

The storage section 82 stores the program 86, the correspondence relationship (will be described in detail later) between the jetting angle of a liquid droplet, which is set in advance, and the modulation voltage Vc or the phase difference tc, and the like.

In the present exemplary embodiment, at least one of the modulation voltage Vc and the phase difference tc between the jetting waveform and the modulation waveform and the correspondence relationship between at least the one and the jetting angle θ are stored in advance in the storage section 82. The control section 84 reads either or both the modulation voltage Vc and/or the phase difference tc corresponding to the jetting angle θ set in advance according to the jetting state (for example, data indicating the defective nozzle 52) of the nozzle 52 and/or the image data input from the outside, such as an external control unit that controls the entire image forming apparatus 10, and gives an instruction to the application section 81.

The application section 81 generates a jetting waveform, which is set in advance according to the image data, and applies it to the piezoelectric element 70A of the ejector 21 and also generates a modulation waveform for changing the jetting angle (modulating the jetting direction) of a liquid droplet jetted from the nozzle 52 and applies it to the piezoelectric element 70B, under the control of the control section 84.

An operation of changing the jetting angle (jetting direction) of a liquid droplet jetted from the nozzle 52 by applying the jetting waveform and the modulation waveform, which are generated by the liquid droplet jetting head driving device 80, to the piezoelectric elements 70A and 70B will be described.

Figure 5:
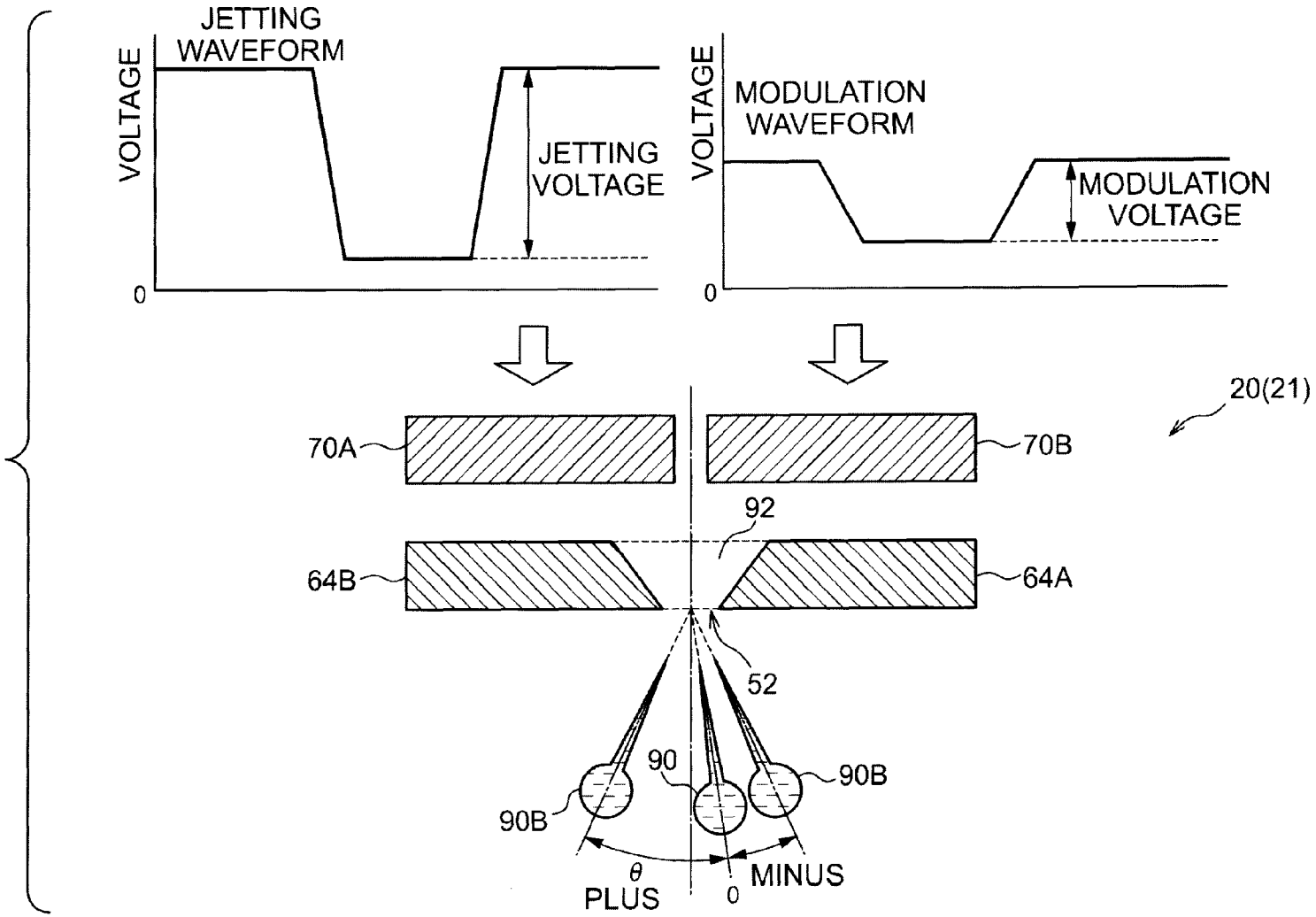
FIG. 5 is an explanatory view for explaining an operation of changing the jetting angle of a liquid droplet jetted from a nozzle by applying a jetting waveform and a modulation waveform to piezoelectric elements in the present exemplary embodiment.
Figure 6A:
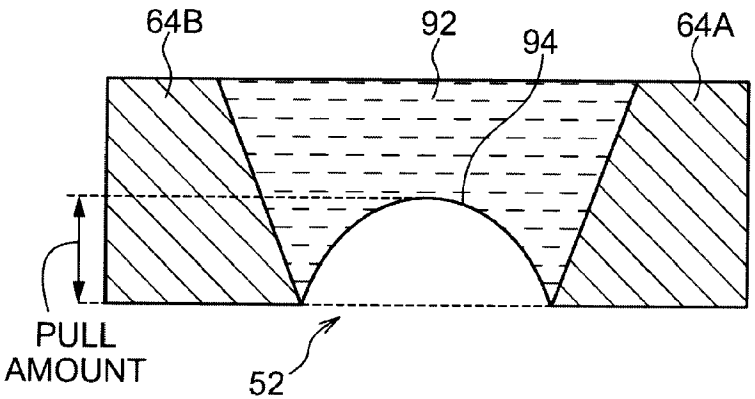
FIGS. 6A to 6C are explanatory views for explaining deformation of a liquid level of a liquid droplet, which is pulled to the inside of a nozzle by application of a jetting waveform, caused by application of a modulation wave in the present exemplary embodiment.
Figure 6B:
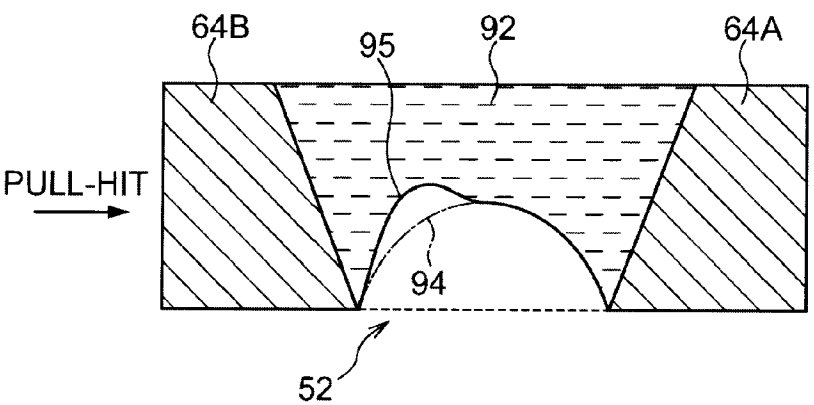
Figure 6C:
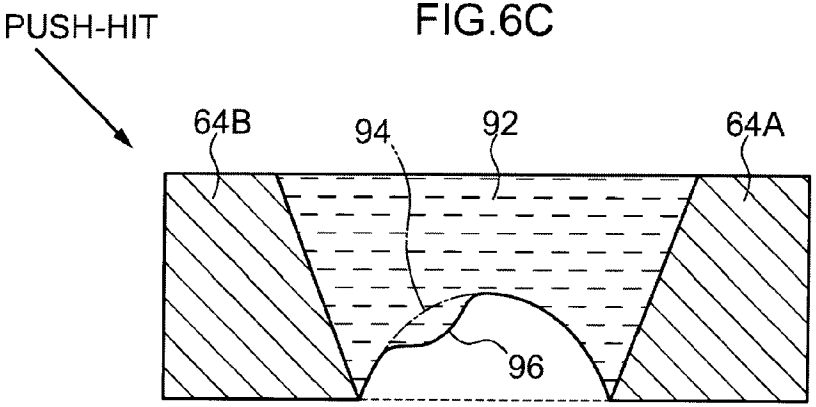

FIG. 5 is a view for explaining the operation of changing the jetting angle of a liquid droplet jetted from the nozzle 52 by applying the jetting waveform and the modulation waveform to the piezoelectric elements 70A and 70B, respectively. FIGS. 6A to 6C are views for explaining deformation of a liquid level of liquid, which is pulled to the inside of the nozzle 52 by application of the jetting waveform, caused by application of the modulation wave.

A jetting waveform, a specific example of which is shown in FIG. 5, is applied to the piezoelectric element 70A. The jetting waveform is a waveform having the jetting voltage Vm, which makes a liquid droplet 90 jet to the outside of the nozzle 52, even when only the jetting waveform is applied (no modulation waveform is applied to the piezoelectric element 70B). As shown in FIG. 6, by application of the jetting waveform, liquid (ink in the present exemplary embodiment) 92 is pulled to the inside of the nozzle 52 and a liquid level 94 is formed inside the nozzle. In addition, applying a waveform for pulling the liquid 92 to the inside of the nozzle 52 as described above is called "pull-hit" (pull hitting, pulling).

A modulation waveform, a specific example of which is shown in FIG. 5, is applied to the piezoelectric element 70B. The modulation waveform is a waveform which does not allow the liquid droplet 90 to be jetted to the outside of the nozzle 52 when only the modulation waveform is applied (that is, no jetting waveform is applied to the piezoelectric element 70A). The modulation waveform is a waveform having the modulation voltage Vc for changing the jetting angle of the liquid droplet 90 jetted from the nozzle 52 by forming a liquid level 95 (see FIG. 6B), which is obtained by pulling the liquid level further inside the nozzle 52, or a liquid level 96 (see FIG. 6C), which is pushed in the outside direction of the nozzle 52, by partially changing the liquid level (liquid meniscus) 94 of the liquid 92 pulled to the inside of the nozzle 52 by application of the jetting waveform. In addition, applying a waveform for pushing the liquid 92 to the outside of the nozzle 52 is called "push-hit" (push hitting, pushing). FIG. 6B shows a state where the liquid level 94 formed by a pull-hit type jetting waveform is deformed to the liquid level 95 by a pull-hit type modulation waveform. FIG. 6C shows a state where the liquid level 94 formed by the pull-hit type jetting waveform is deformed to the liquid level 96 by a push-hit type modulation waveform.

Moreover, as a more specific example, an operation of changing the jetting angle of the liquid droplet 90 using the liquid droplet jetting head driving device 80 in the present exemplary embodiment will be described in detail. Here, it is assumed that the jetting angle of the liquid droplet 90 is positive (plus) when the liquid droplet 90 is inclined to the piezoelectric element 70A (in the case of liquid droplet 90B) and negative (minus) when the liquid droplet 90 is inclined to the piezoelectric element 70B (in the case of liquid droplet 90A) with a direction of the liquid droplet 90, which is jetted from the nozzle 52 when the jetting waveform is applied only to the piezoelectric element 70A in order to drive the piezoelectric element 70A, as a reference. As a specific example, the case where aqueous pigment ink having viscosity of 5.88 mPa·s and surface tension of 30.9 mN/m is used as liquid will be described.

Figure 7:
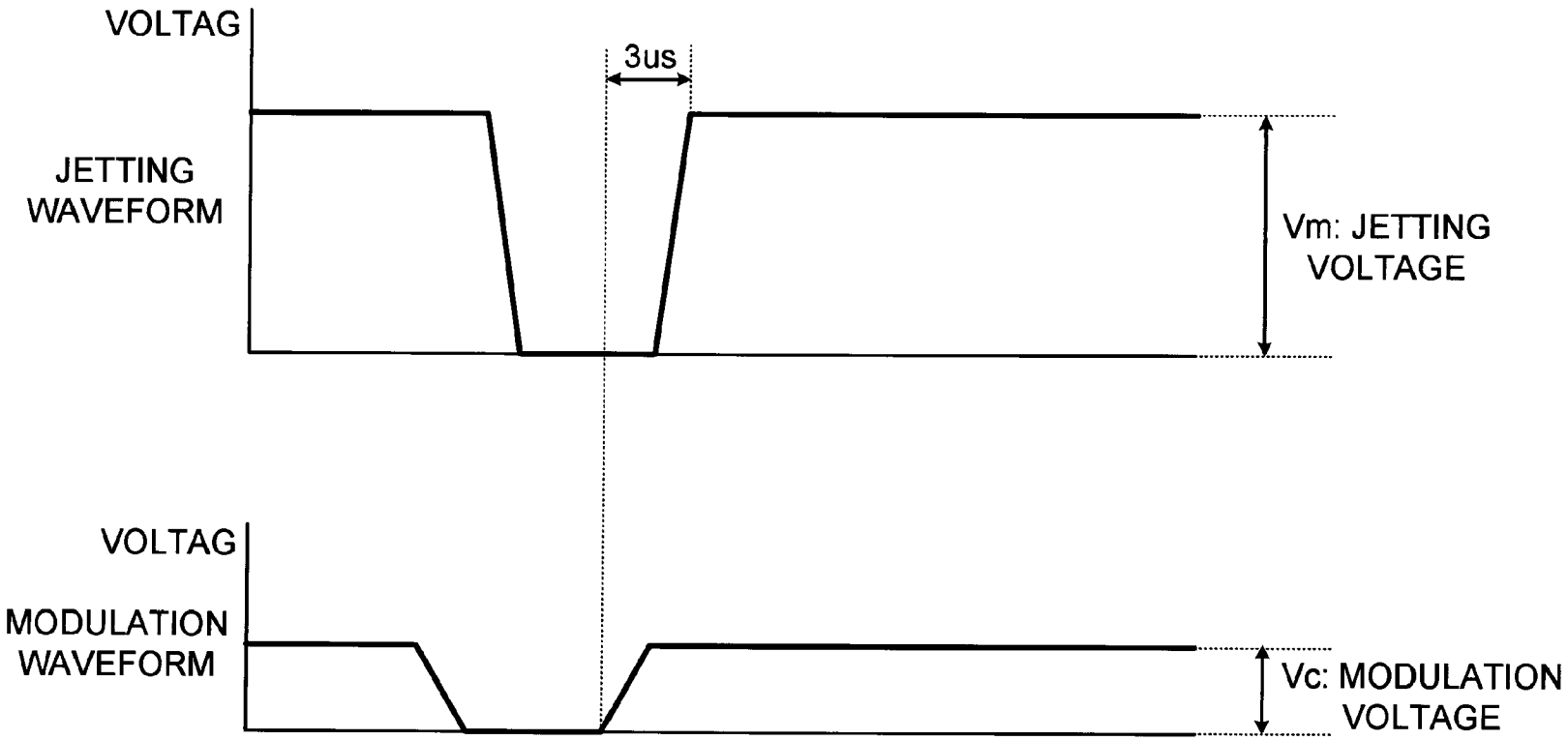
FIG. 7 is an explanatory view for explaining a specific example of a driving waveform when a jetting waveform is a pull-hit type waveform in the present exemplary embodiment.
Figure 8:
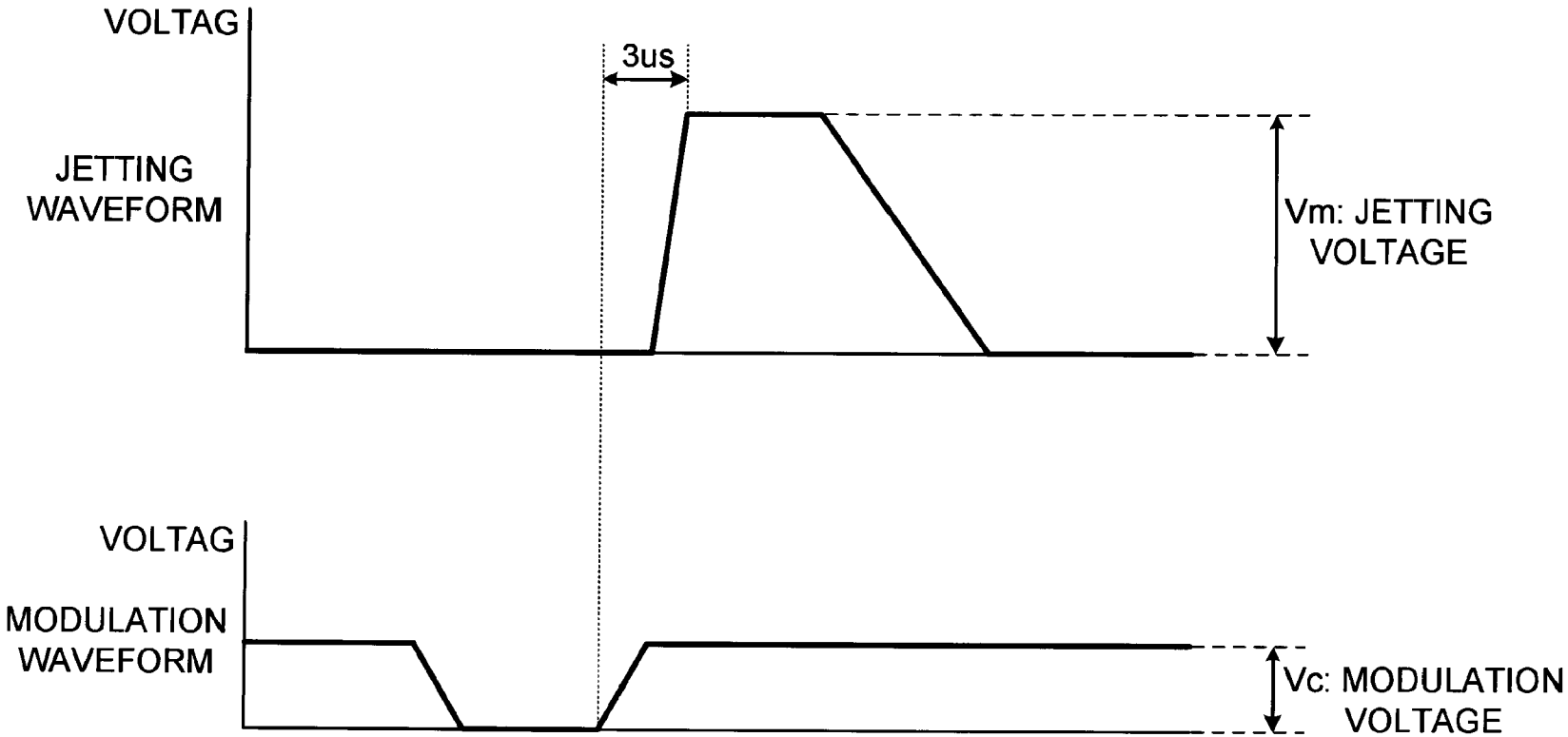
FIG. 8 is an explanatory view for explaining a specific example of a driving waveform when a jetting waveform is a push-hit type waveform in the present exemplary embodiment.
Figure 10:
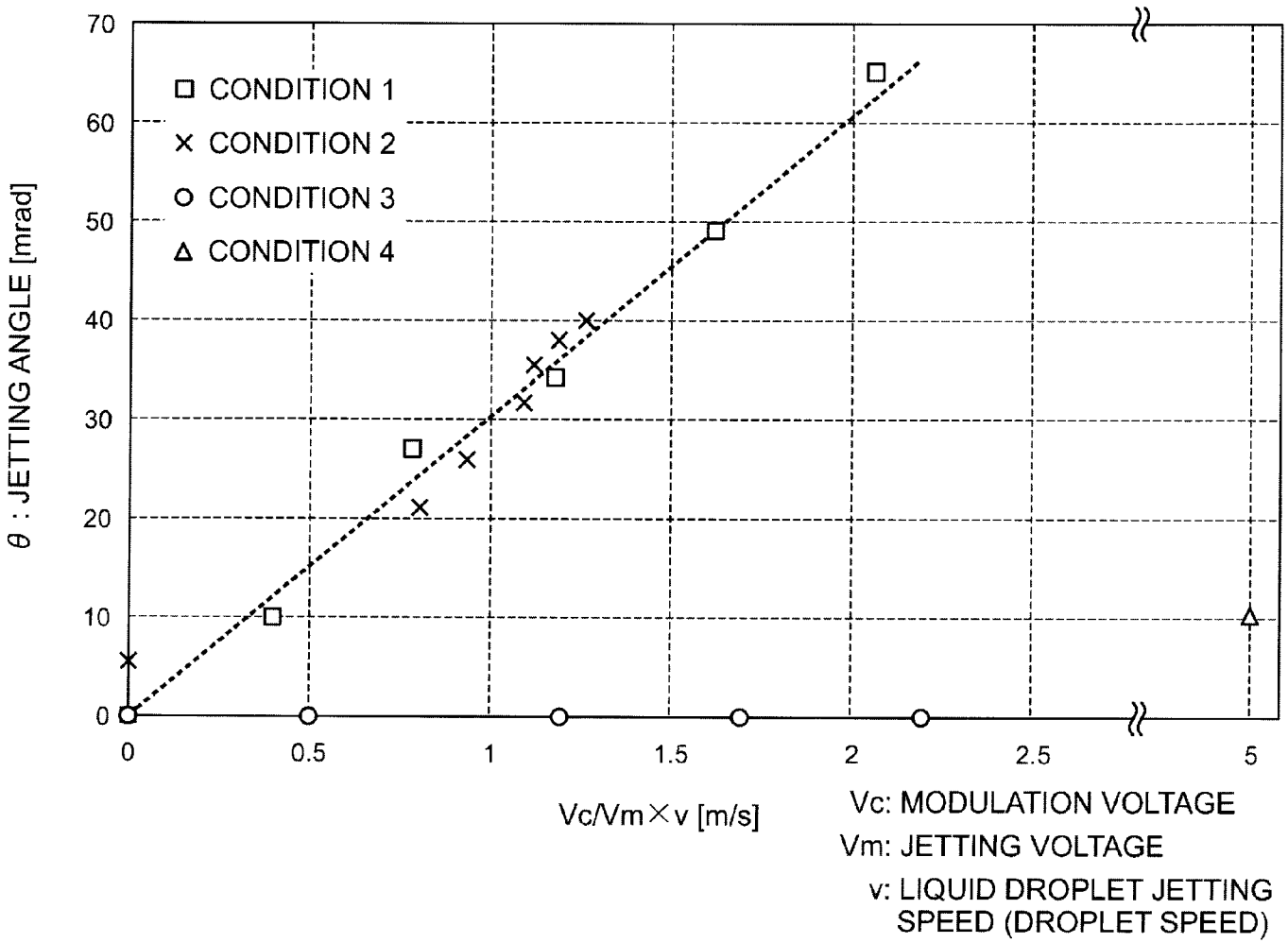
FIG. 10 is an explanatory view for explaining the relationship between modulation force (modulation voltage Vc/jetting voltage Vm)×pull amount of a liquid level (liquid droplet jetting speed v) and the jetting angle θ.

Regarding the case where the piezoelectric elements 70A and 70B are driven by applying a pull-hit type jetting waveform to the piezoelectric element 70A and a push-hit type modulation waveform to the piezoelectric element 70B as shown in FIG. 7, and the case where the piezoelectric elements 70A and 70B are driven by applying a push-hit type jetting waveform to the piezoelectric element 70A and a push-hit type modulation waveform to the piezoelectric element 70B as shown in FIG. 8, driving results under condition 1, condition 2, and condition 3 shown in FIG. 9 are shown in FIG. 10. FIG. 10 is a view showing the relationship between modulation force (modulation voltage Vc/jetting voltage Vm)×pull amount of a liquid level (liquid droplet jetting speed v) and the jetting angle θ. The results of the conditions 1 to 3 are shown in FIG. 10.

Figure 11:
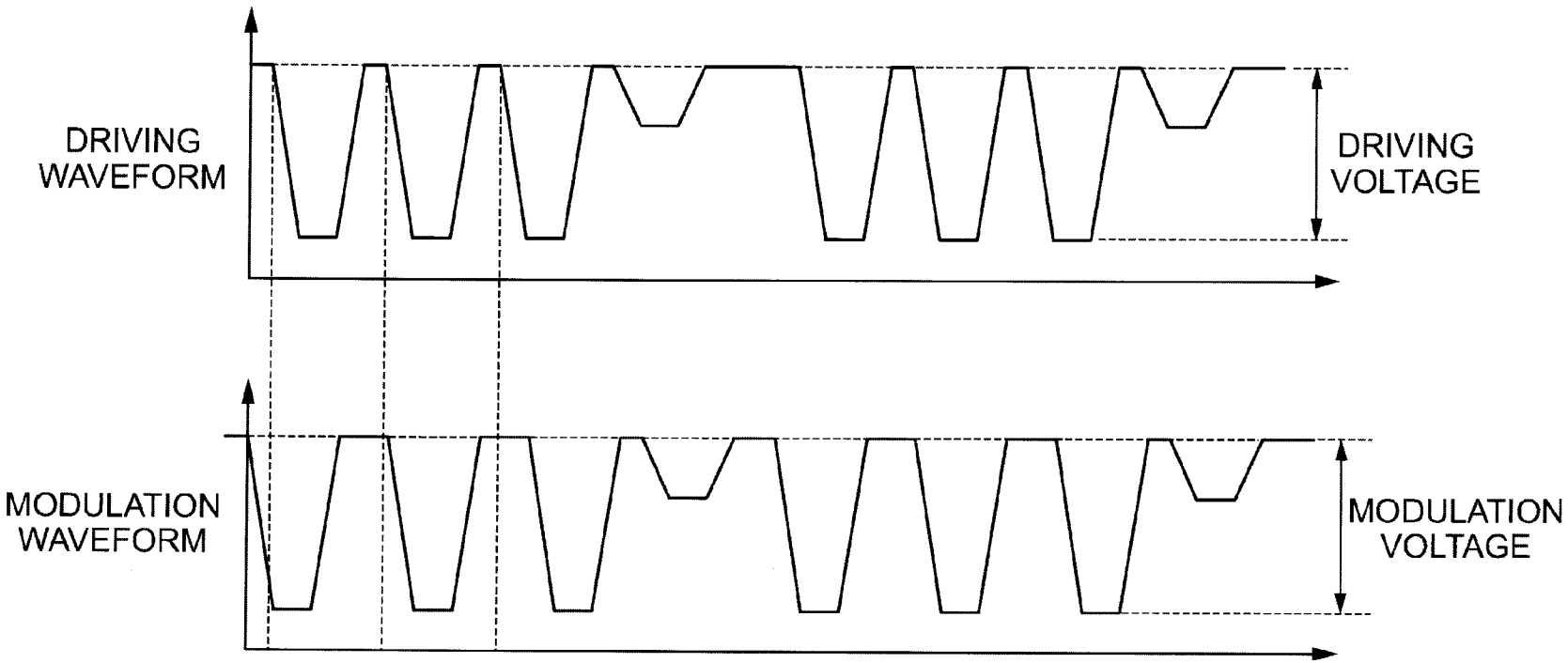
FIG. 11 is an explanatory view for explaining a specific example when a driving waveform and a modulation waveform having the same voltage value are applied to piezoelectric elements.

A driving result in the case where the piezoelectric elements 70A and 70B are driven under the condition 4 shown in FIG. 12 by applying a driving waveform to the piezoelectric element 70A and a modulation waveform to the piezoelectric element 70B as shown in FIG. 11 is shown in FIG. 10. In addition, the driving waveform shown in FIG. 11 is a waveform which does not allow a liquid droplet to be jetted to the outside of the nozzle 52 even if only the driving waveform is applied to the piezoelectric element 70A. The modulation waveform shown in FIG. 11 is a waveform which does not allow a liquid droplet to be jetted to the outside of the nozzle 52 even if only the modulation waveform is regularly applied to the piezoelectric element 70B. Both the driving voltage of the driving waveform and the modulation voltage of the modulation waveform are 10 V, and the phases are different. By applying the driving waveform and the modulation waveform to the piezoelectric elements 70A and 70B, respectively, the jetting angle of a liquid droplet is changed by the synergy effect of the pull-hit and push-hit of the two waveforms.

As shown in FIG. 10, under the condition 3 which is the case of a push-hit type jetting waveform (see FIG. 8), the jetting angle θ does not change even if the liquid droplet jetting speed v is changed. Under the condition 1 which is the case of a pull-hit type jetting waveform (see FIG. 7), the jetting angle θ changes according to the modulation voltage Vc. Under the condition 2, the jetting angle θ changes according to the liquid droplet jetting speed v. Under the condition 4, the jetting angle θ is smaller than those under the conditions 1 and 2, that is, a variation in the jetting angle is small.

As indicated by the driving results of the conditions 1 to 3, the size of the jetting angle θ is changed by setting the jetting waveform applied to the piezoelectric element 70A as a pull-hit type waveform. As indicated by the driving results of the conditions 1 and 4, since the liquid level is pulled to the inside of the nozzle 52 by the jetting waveform which makes a liquid droplet jet from the nozzle 52 when applied alone, the pull amount of the liquid level becomes large. Accordingly, even when a modulation waveform of the small modulation voltage Vc (driving energy) is applied to the piezoelectric element 70B, the jetting angle θ is changed. In other words, if the conditions 1 and 4 are compared, the modulation voltage Vc of a modulation waveform under the condition 1 is small when the jetting angle θ is the same.

That is, since the pull amount of the liquid level becomes large by pulling the liquid level to the inside of the nozzle 52 by the pull-hit type jetting waveform which makes a liquid droplet jet from the nozzle 52 when applied alone, the large jetting angle θ is obtained even if the ratio (here, modulation voltage Vc/jetting voltage Vm) of a modulation voltage to one voltage is small.

Figure 13:
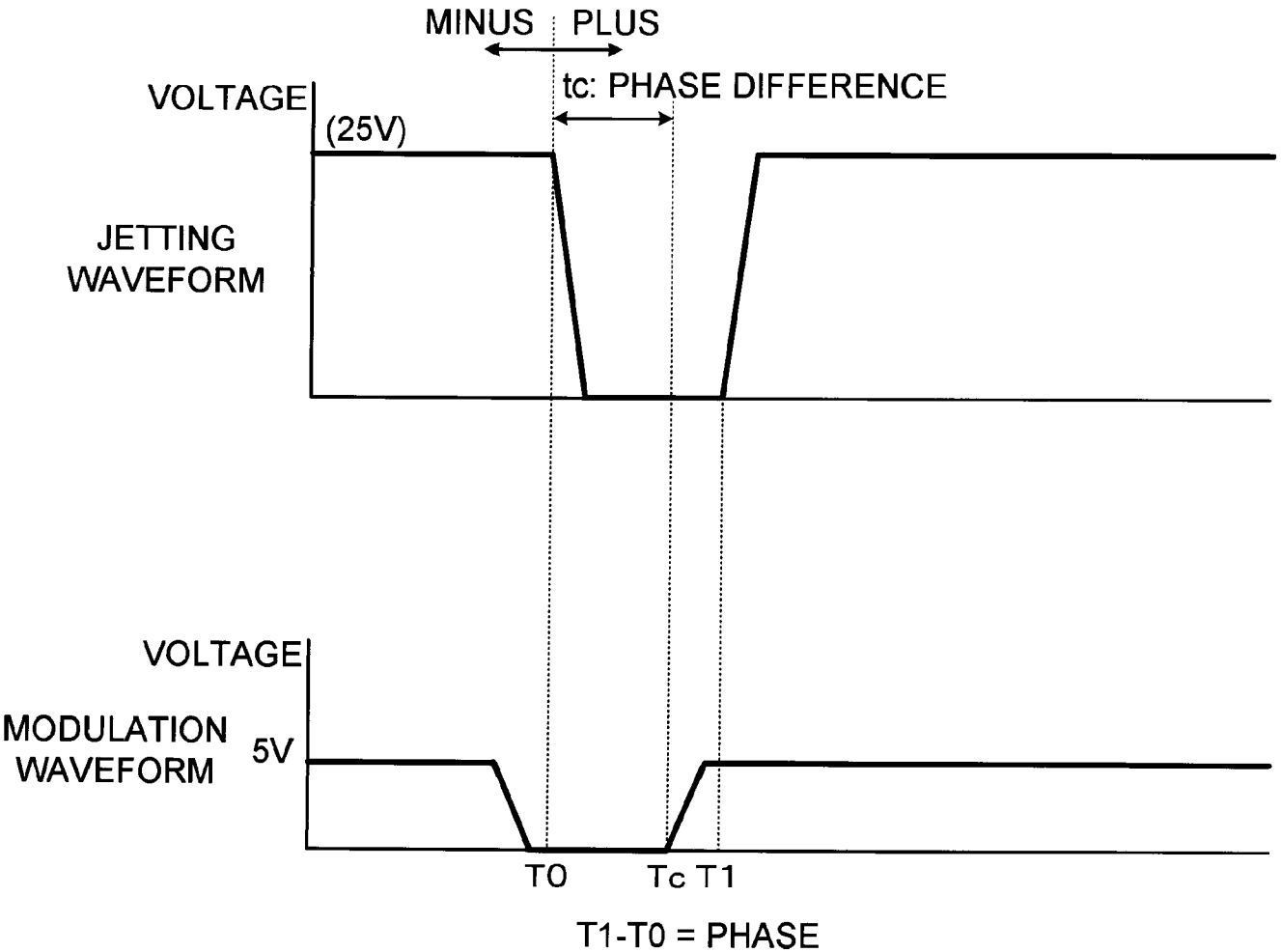
FIG. 13 is an explanatory view for explaining a specific example of a jetting waveform and a modulation waveform in the present exemplary embodiment.
Figure 15:
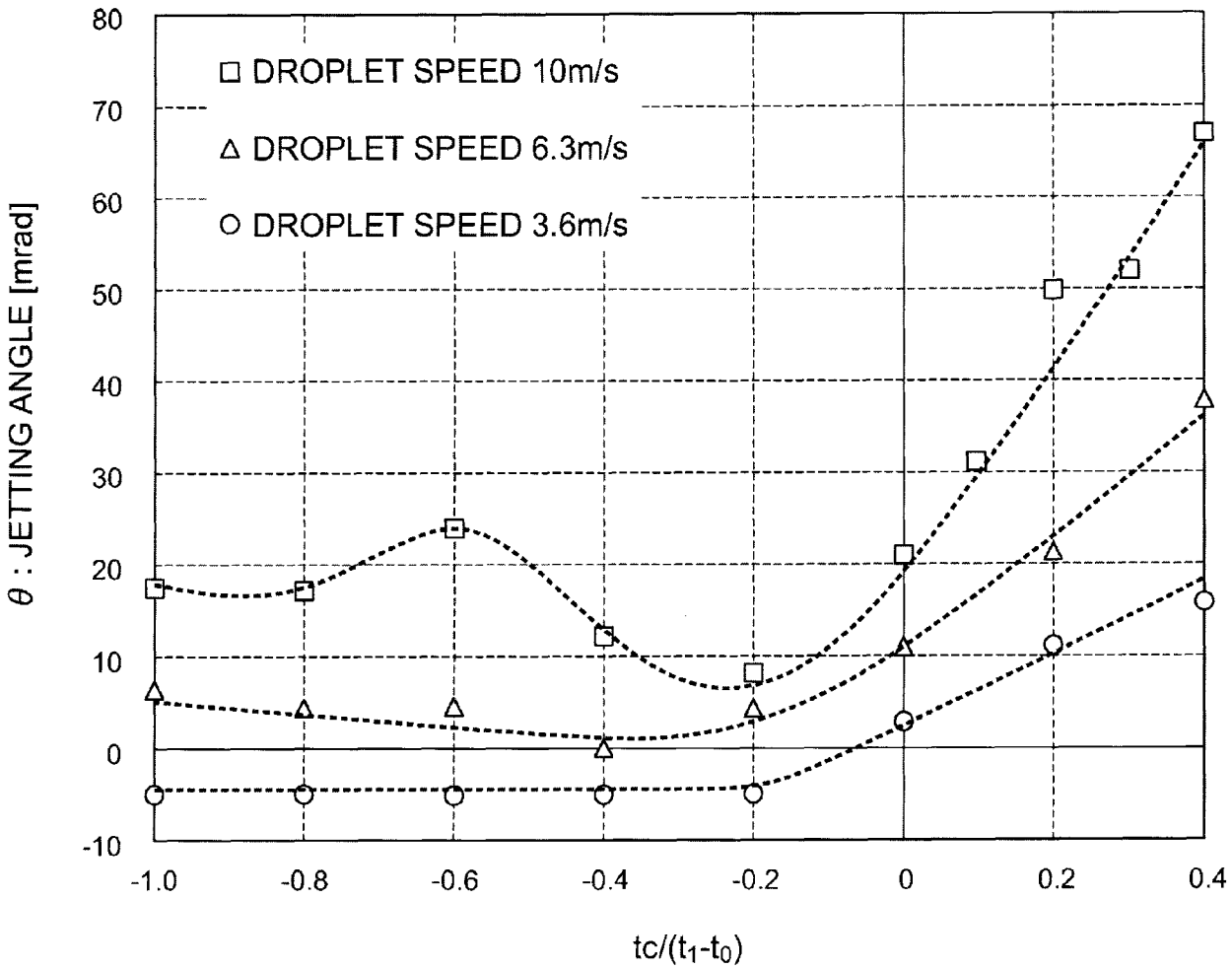
FIG. 15 is a view showing a specific example of the relationship between the jetting angle and the phase difference between a jetting waveform and a modulation waveform in the present exemplary embodiment.

The relationship between the jetting angle and the phase difference between a jetting waveform and a modulation waveform when the modulation waveform is a push-hit type waveform will be described with reference to FIGS. 13 to 15. FIG. 13 shows a jetting waveform and a modulation waveform. FIG. 14 shows a driving condition (condition 5). FIG. 15 shows the relationship between the jetting angle and the phase difference between a jetting waveform and a modulation waveform. As shown in FIG. 13, under the condition 5, the modulation voltage is set to 5 V regardless of the liquid droplet jetting speed. In addition, since the pull amount of liquid into the nozzle 52 changes with the liquid droplet jetting speed v, the jetting voltage is set to about 25 V even though the jetting voltage is adjusted. As shown in FIG. 13, in the present exemplary embodiment, the time at which liquid starts to be pulled to the inside of the nozzle 52 is set to T0 and the time at which pulling of the liquid ends (operation in which the pulled liquid level returns to the original state starts) is set to T1. T1−T0 corresponds to ½ of the natural period Tx of a pressure elastic wave of the pressure chamber 54A. The time at which deformation of the liquid level of liquid pulled to the inside of the nozzle 52 starts is set to Tc. The phase difference between the jetting waveform and the modulation waveform is set to tc.

Figure 16:
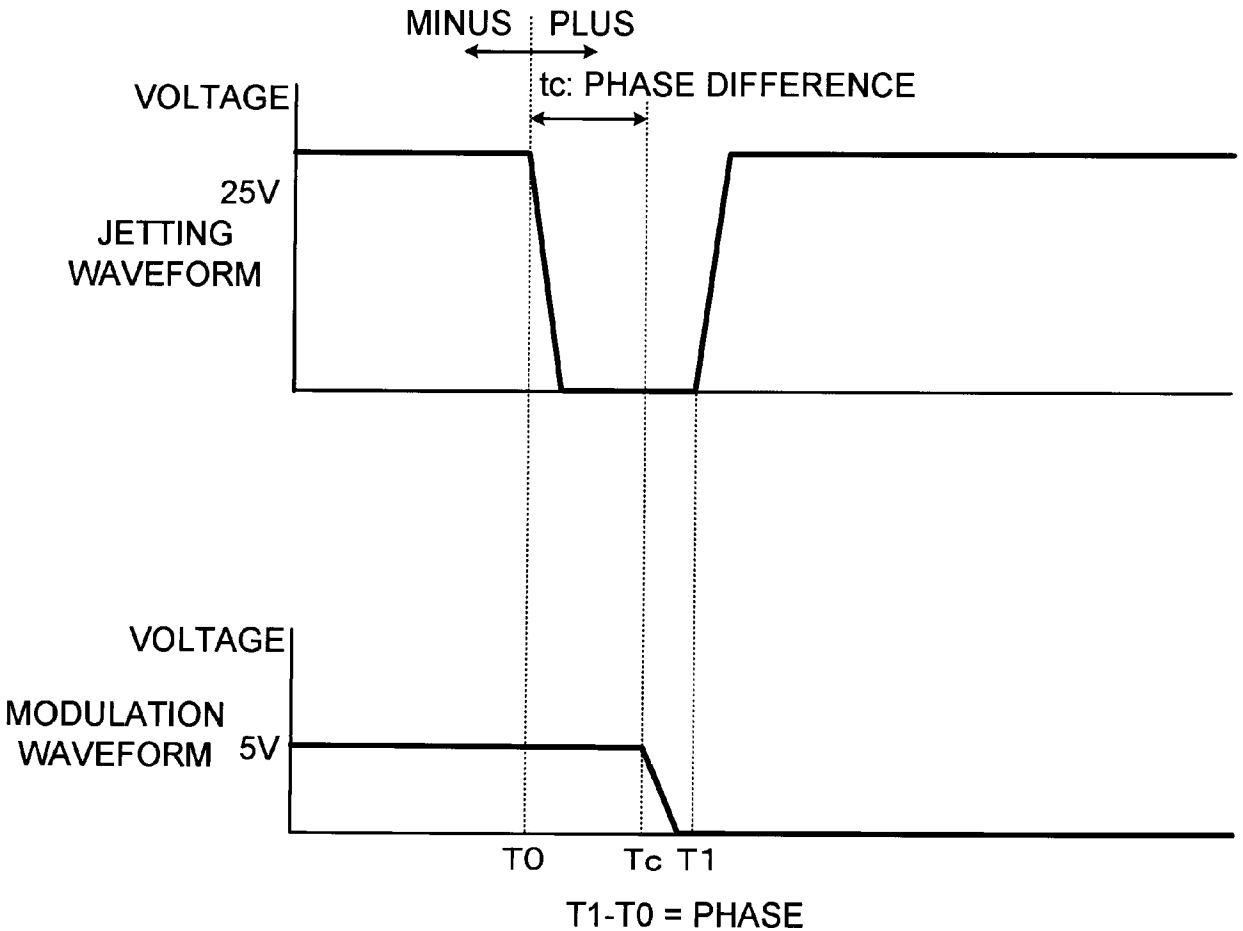
FIG. 16 is an explanatory view for explaining a specific example of a jetting waveform and a modulation waveform in the present exemplary embodiment.
Figure 18:
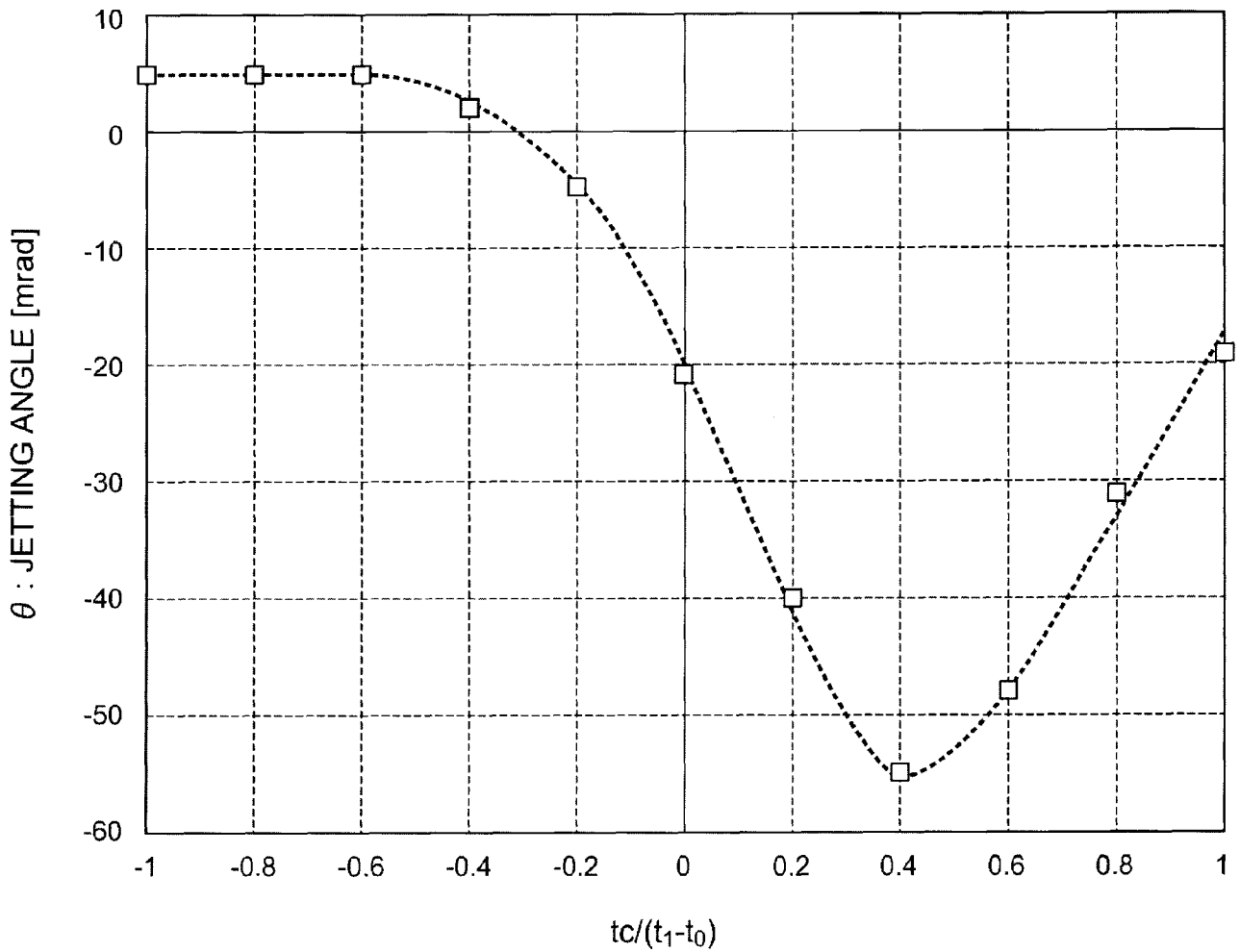
FIG. 18 is a view showing a specific example of the relationship between the jetting angle and the phase difference between a jetting waveform and a modulation waveform in the present exemplary embodiment.

The relationship between the jetting angle and the phase difference between a jetting waveform and a modulation waveform when the modulation waveform is a pull-hit type waveform will be described with reference to FIGS. 16 to 18. FIG. 16 shows a jetting waveform and a modulation waveform, FIG. 17 shows a driving condition (condition 6), and FIG. 18 shows the relationship between the jetting angle and the phase difference between a jetting waveform and a modulation waveform. Here, a waveform in which the voltage rises to a bias voltage (5 V) at a timing earlier than at least the time T0 so that jetting of a liquid droplet is not affected and the voltage drops from a modulation voltage, which is the bias voltage, at the time Tc, which is a timing at which the phase difference is tc, is used as the modulation waveform shown in FIG. 16.

As shown in FIG. 15, when the modulation waveform is a push-hit type waveform, the jetting angle θ increases with an increase in the phase difference tc in a range of $-0.2 \leqq tc/(T1-T0) \leqq 0.4$. In addition, when the liquid droplet jetting speed is 10 m/s and 6.3 m/s, jetted liquid droplets are separated if $tc/(T1-T0)$ exceeds 0.4. As shown in FIG. 18, when the modulation waveform is a pull-hit type waveform, the jetting angle θ decreases with an increase in the phase difference tc in a range of $-0.4 \leqq tc/(T1-T0) \leqq 0.4$, and the jetting angle θ decreases if $tc/(T1-T0)$ exceeds 0.4.

As shown in FIGS. 15 and 18, although the jetting angle θ depends on the liquid droplet jetting speed, it is generally preferable that the relationship of the phase difference tc, the time T1, and the time T0 satisfy $-\frac{1}{2} \leqq tc/(T1-T0) < 1$. That is, when the phase difference tc satisfies the following expression (1), the jetting angle θ of a liquid droplet may be changed by using a jetting waveform and a modulation waveform.

$$T0-Tx/4 \leqq tc < T0+Tx/2 \quad (1)$$

Moreover, when the modulation waveform is a push-hit type waveform in order to change the jetting angle θ in the positive direction, it is preferable that the relationship of the phase difference tc, the time T1, and the time T0 satisfy $-\frac{1}{4} \leqq tc/(T1-T0) < \frac{2}{5}$. That is, it is preferable that the phase difference tc satisfies the following expression (2). In addition, it is more preferable to satisfy $-\frac{1}{5} \leqq tc/(T1-T0) \leqq \frac{2}{5}$ which is a range where the jetting angle θ does not depend on the liquid droplet jetting speed and increases with an increase in the phase difference tc in FIG. 15.

$$T0-Tx/8 \leqq tc < T0+Tx/5 \quad (2)$$

Moreover, when the modulation waveform is a pull-hit type waveform in order to change the jetting angle θ in the negative direction, it is preferable that the relationship of the phase difference tc, the time T1, and the time T0 satisfy $-\frac{1}{3} \leqq tc/(T1-T0) < 1$. That is, it is preferable that the phase difference tc satisfies the following expression (3). In addition, it is more preferable to satisfy $-\frac{1}{3} \leqq tc/(T1-T0) \leqq \frac{2}{5}$ which is a range where the jetting angle θ increases with an increase in the phase difference tc in FIG. 18.

$$T0-Tx/6 \leqq tc < T0+Tx/2 \quad (3)$$

First Example

In a first specific example, the control section 84 makes the application section 81 generate a pull-hit type jetting waveform and apply it to the piezoelectric element 70A and makes the application section 81 apply a push-hit type modulation waveform with a different modulation voltage to the piezoelectric element 70B. Moreover, in the first example, the phase difference tc between the jetting waveform and the modulation waveform is set to 2 μs at which the jetting angle becomes large. In addition, the jetting angle may be changed with good energy efficiency by setting the phase difference tc to 2 μs as described above. The modulation voltage is changed from 0 V (level 1) to 3.5 V (level 6). As shown in FIG. 19, the jetting angle θ of a liquid droplet is 0 mrad when the modulation voltage is 0 V (level 1), the jetting angle θ of a liquid droplet is 10 mrad when the modulation voltage is 0.6 V (level 2), the jetting angle θ of a liquid droplet is 20 mrad when the modulation voltage is 1.3 V (level 3), the jetting angle θ of a liquid droplet is 30 mrad when the modulation voltage is 2.1 V (level 4), the jetting angle θ of a liquid droplet is 40 mrad when the modulation voltage is 2.8 V (level 5), and the jetting angle θ of a liquid droplet is 50 mrad when the modulation voltage is 3.5 V (level 6). That is, the jetting angle θ is controlled in the unit of 10 mrad by using the modulation voltage Vc of level 1 to level 6.

That is, in the first example, the correspondence relationship between the jetting angle and the modulation voltage Vc shown in FIG. 19 is stored in the storage section 82 and the control section 84 sends to the application section 81 an instruction regarding the modulation voltage (or the level), which corresponds to the angle at which a liquid droplet needs to be jetted, according to image data or the like, for example. As a result, the jetting angle θ of a liquid droplet jetted from the nozzle 52 is controlled without changing the phase difference between the jetting angle and the modulation voltage, a pulse interval, or the like.

Second Example

Figure 20:
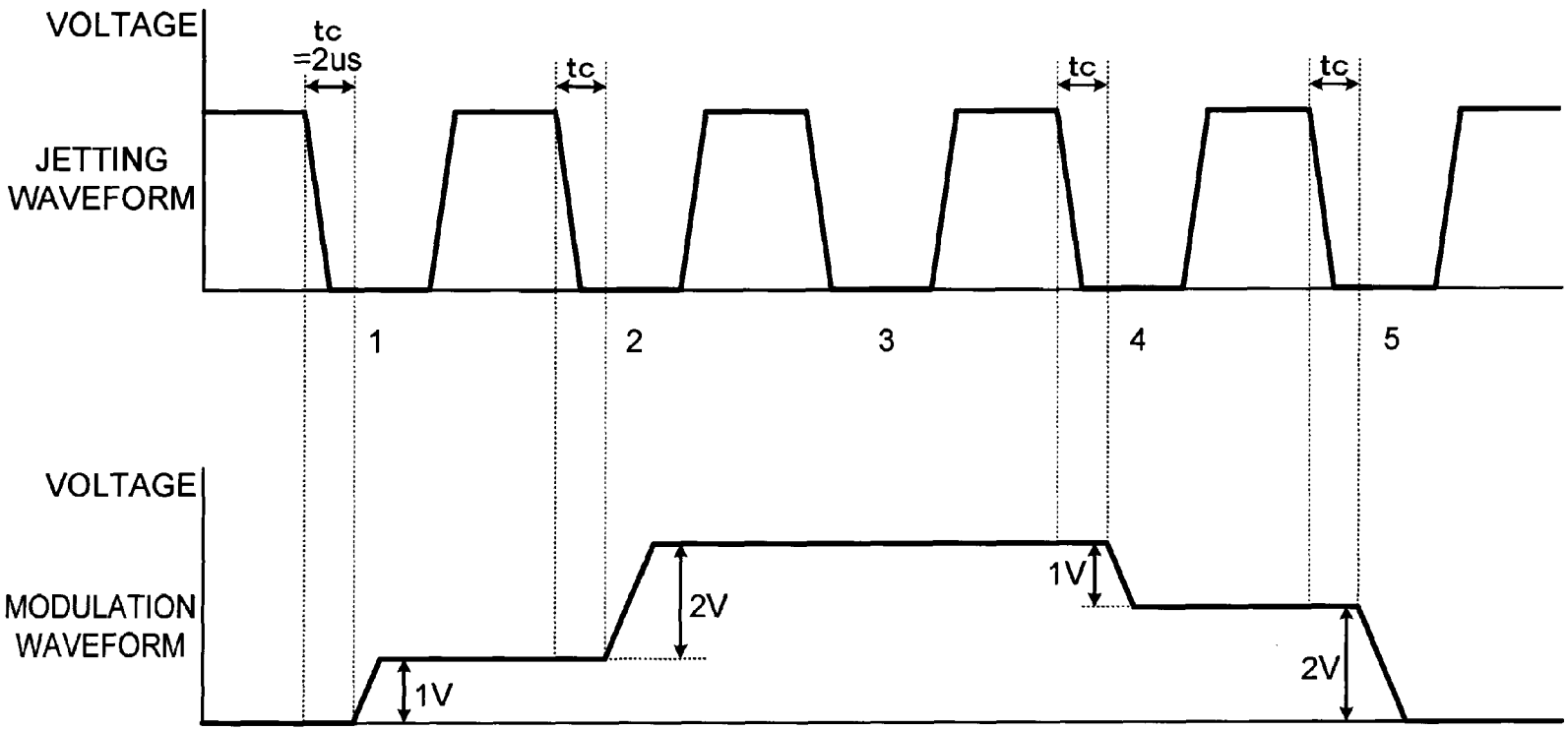
FIG. 20 is an explanatory view for explaining a modulation waveform in a second example.

In a second specific example, the phase difference tc between the jetting waveform and the modulation waveform is set to 2 μs similar to the first example, and a modulation waveform including a push-hit type modulation waveform and a pull-hit type modulation waveform with different modulation voltages is applied to the piezoelectric element 70B for each jetting using a jetting waveform as shown in FIG. 20. The modulation waveform is set as a push-hit type waveform with a modulation voltage of 1 V in the first jetting (level 1), the modulation waveform is set as a push-hit type waveform with a modulation voltage of 2 V in the second jetting (level 2), the modulation waveform is not applied (modulation waveform with a modulation voltage of 0 V) in the third jetting (level 3), the modulation waveform is set as a pull-hit type waveform with a modulation voltage of 1 V in the fourth jetting (level 4), and the modulation waveform is set as a pull-hit type waveform with a modulation voltage of 2 V in the fifth jetting (level 5). As a result, in the second example, the jetting angle θ of a liquid droplet is changed in positive and negative directions when a modulation waveform is not applied to the piezoelectric element 70B.

Thus, in the second example, the change range of the jetting angle θ becomes wide.

In the second example, the direction of the jetting angle θ is changed in five levels by controlling rising, falling, and the voltage value in one modulation pulse. As a result, the lifespan and heat generation of the piezoelectric elements 70A and 70B are improved.

Third Example

In a third specific example, the control section 84 makes the application section 81 generate a pull-hit type jetting waveform and apply it to the piezoelectric element 70A and makes the application section 81 apply a push-hit type modulation waveform with a different phase difference tc to the piezoelectric element 70B. Moreover, in the third example, the modulation voltage is set to 5 V in cases other than the level 1 in which the jetting angle θ is not changed. The phase difference tc is changed from −0.6 μs (level 2) to 1.7 μs (level 7). As shown in FIG. 21, the jetting angle θ of a liquid droplet is 0 mrad in the case of the level 1, the jetting angle θ is 10 mrad when the phase difference tc is −0.6 μs (level 2), the jetting angle θ is 20 mrad when the phase difference tc is 0 μs (level 3), the jetting angle θ is 30 mrad when the phase difference tc is 0.5 μs (level 4), the jetting angle θ is 40 mrad when the phase difference tc is 0.8 μs (level 5), the jetting angle θ is 50 mrad when the phase difference tc is 1.3 μs (level 6), and the jetting angle θ is 60 mrad when the phase difference tc is 1.7 μs (level 7). That is, the jetting angle θ is controlled in units of 10 mrad by using the phase difference tc of level 1 to level 7.

That is, in the third example, the correspondence relationship between the jetting angle and the phase difference tc shown in FIG. 21 is stored in the storage section 82, for example. According to the image data or the like, the control section 84 sends to the application section 81 an instruction of the modulation voltage (or the level) corresponding to the angle at which a liquid droplet needs to be jetted. As a result, the jetting angle θ of a liquid droplet jetted from the nozzle 52 is controlled without changing the modulation voltage Vc, pulse intervals of the jetting waveform and the modulation waveform, or the like.

Fourth Example

Figure 22:
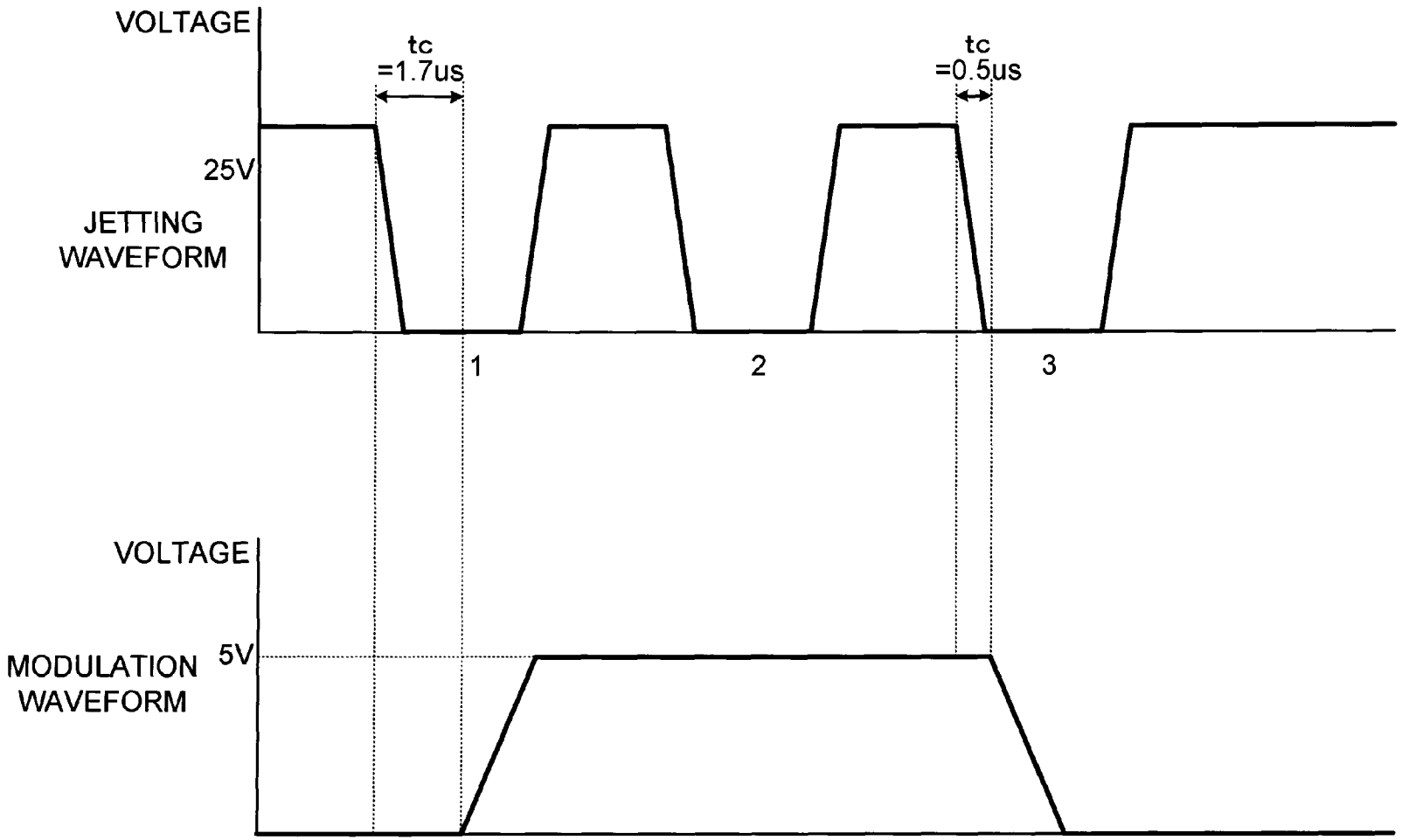
FIG. 22 is an explanatory view for explaining a modulation waveform in a fourth example.

In a fourth specific example, the modulation voltage of a modulation waveform is set to 5 V similar to the third example, and a modulation waveform including a push-hit type modulation waveform and a pull-hit type modulation waveform with different phase differences tc is applied to the piezoelectric element 70B for each jetting using a jetting waveform as shown in FIGS. 22 and 23. The modulation waveform is set as a push-hit type waveform with a phase difference tc of 1.7 μs in the first jetting (level 1), the modulation voltage is not applied (modulation waveform with a modulation voltage of 0 V) in the second jetting (level 2), and the modulation waveform is set as a pull-hit type waveform with a phase difference tc of 0.5 μs in the third jetting (level 3). As a result, in the fourth example, the jetting angle θ of a liquid droplet is changed in positive and negative directions when a modulation waveform is not applied to the piezoelectric element 70B.

That is, in the fourth example, the correspondence relationship between the jetting angle and the phase difference tc shown in FIG. 23 is stored in the storage section 82, for example. According to the image data or the like, the control section 84 sends to the application section 81 an instruction of the modulation voltage (or the level) corresponding to the angle at which a liquid droplet needs to be jetted. As a result, the jetting angle θ of a liquid droplet jetted from the nozzle 52 is controlled without changing the modulation voltage Vc, pulse intervals of the jetting waveform and the modulation waveform, or the like.

Thus, in the fourth example, the change range of the jetting angle θ becomes wide.

Moreover, in the fourth example, the direction of the jetting angle θ is changed in three levels by controlling the phase difference tc in the rising and falling in one modulation pulse. As a result, the lifespan and heat generation of the piezoelectric elements 70A and 70B are improved.

Fifth Embodiment

Figure 24:
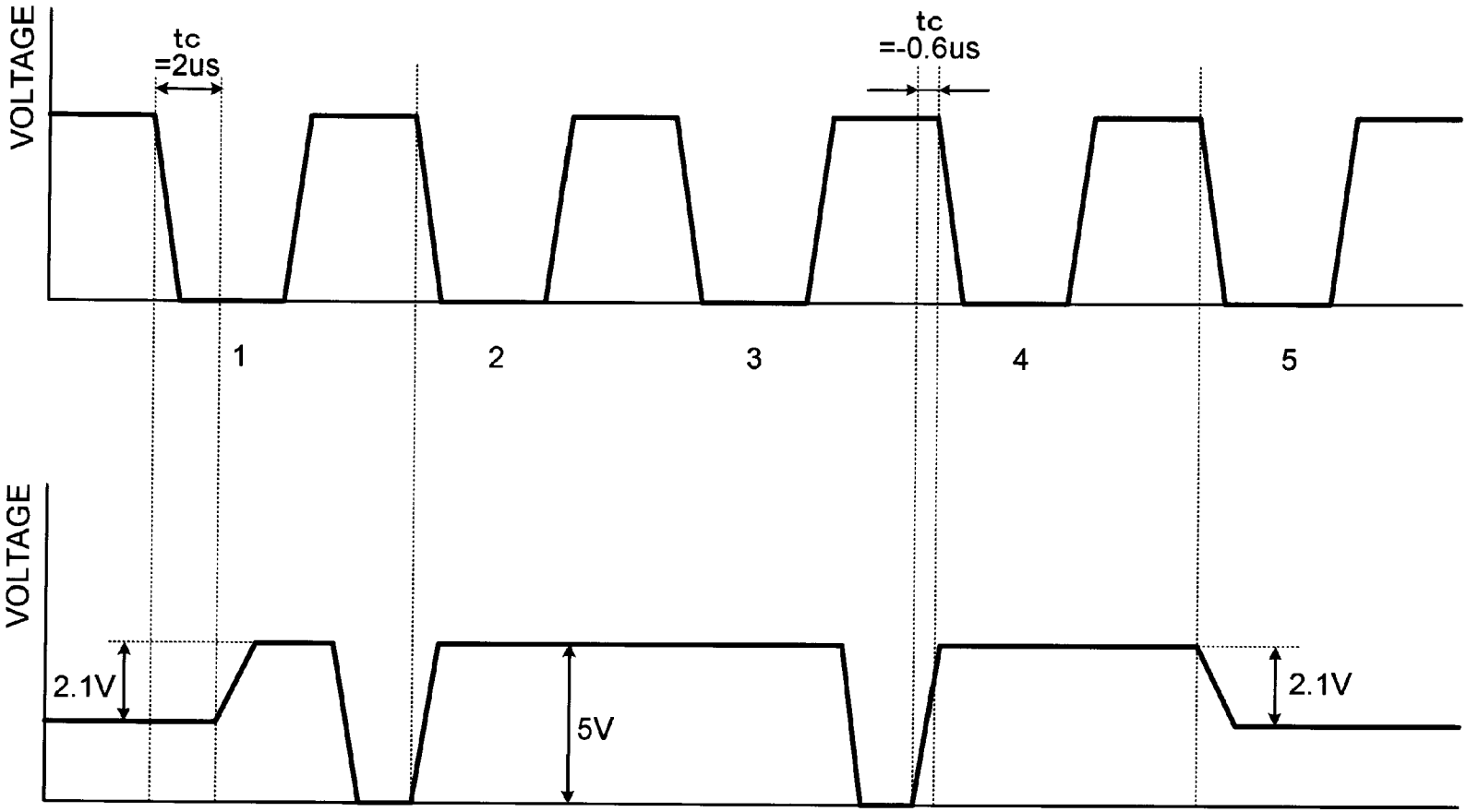
FIG. 24 is an explanatory view for explaining a modulation waveform in a fifth example.

In a fifth specific example, as shown in FIG. 24, the control section 84 makes the application section 81 generate a pull-hit type jetting waveform and apply it to the piezoelectric element 70A and makes the application section 81 apply to the piezoelectric element 70B a push-hit type modulation waveform and a pull-hit type modulation waveform which have different phase differences tc and different modulation voltages Vc. The phase difference tc and the modulation voltage Vc are changed from level 1 to level 5, as shown in FIG. 25. The jetting angle θ of a liquid droplet is 30 mrad in the case of first jetting (level 1, phase difference tc of 2 μs, and modulation voltage Vc of 2.1 V), the jetting angle θ is 20 mrad in the case of second jetting (level 2, phase difference tc of 0 μs, and modulation voltage Vc of 5 V), the jetting angle θ is 0 mrad in the case of third jetting (level 3 and a modulation waveform is not applied), the jetting angle θ is 10 mrad in the case of fourth jetting (level 4, phase difference tc of −0.6 μs, and modulation voltage Vc of 5 V), and the jetting angle θ is −10 mrad in the case of fifth jetting (level 5, phase difference tc of 0 μs, and modulation voltage Vc of 2.1 V). That is, the jetting angle θ is controlled in units of 10 mrad by using the phase difference tc and the modulation voltage Vc of level 1 to level 5.

That is, in the fifth example, the correspondence relationship between the jetting angle and the phase difference tc shown in FIG. 25 is stored in the storage section 82, for example. According to the image data or the like, the control section 84 sends to the application section 81 an instruction of the modulation voltage (or the level) corresponding to the angle at which a liquid droplet needs to be jetted. As a result, the jetting angle θ of a liquid droplet jetted from the nozzle 52 is controlled without changing the modulation voltage Vc, pulse intervals of the jetting waveform and the modulation waveform, or the like.

As described above, in the present exemplary embodiment, the control section 84 controls the application section 81 to generate a pull-hit type jetting waveform, which makes a liquid droplet jet from the nozzle 52 when applied alone, and apply it to the piezoelectric element 70A, and to generate a push-hit type or pull-hit type modulation waveform, in which at least one of the phase difference tc and the modulation voltage Vc is set to the value corresponding to the jetting angle of a liquid droplet, and apply it to the piezoelectric element 70B. In this case, since the liquid level is pulled to the inside of the nozzle 52 by application of the jetting waveform, the pull amount of the liquid level becomes large. Accordingly, even if the ratio (here, modulation voltage Vc/jetting voltage Vm) of a modulation voltage Vc to one voltage is small, the large jetting angle θ is obtained.

In the present exemplary embodiment, the modulation voltage Vc is a voltage which does not allow a liquid droplet to be jetted from the nozzle 52 even if only the modulation voltage Vc is applied to the piezoelectric element 70B. Accordingly, when the image forming apparatus 10 includes plural nozzles, it is not necessary to control ON/OFF of a modulation waveform in order to continuously apply a modulation waveform to all nozzles. As a result, electrical wiring, circuit structures, and the like of the application section 81 or the control section 84 and the piezoelectric elements 70A and 70B are simplified.

In addition, the present exemplary embodiment including the first to fifth examples is only a specific example and is not intended to limit the invention.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to be suited to the particular use contemplated. It is intended that the scope of the invention be defined by the following claims and their equivalents.

What is claimed is:

1. A driving device for a liquid droplet jetting device, the liquid droplet jetting device including a plurality of pressure chambers which includes first and second pressure chambers disposed along a predetermined direction with respect to a nozzle from which a liquid droplet is jetted, a first pressure generating unit provided corresponding to the first pressure chamber, and a second pressure generating unit provided corresponding to the second pressure chamber, the first pressure generating unit generating pressure for jetting a liquid droplet outside the nozzle after pulling the liquid inside the nozzle when a first voltage of a predetermined first waveform for jetting the liquid droplet outside the nozzle after pulling the liquid inside the nozzle is applied, the second pressure generating unit generating pressure for deforming a liquid level of the liquid pulled inside the nozzle by applying the first voltage when a second voltage of a second waveform, whose voltage value is smaller than that of the first waveform, for deforming the liquid level of the liquid pulled inside the nozzle by applying the first voltage to the first pressure generating unit is applied, the driving device comprising:

an application unit that generates the first voltage of the first waveform and applies the first voltage of the first waveform to the first pressure generating unit and that generates the second voltage of the second waveform and applies the second voltage of the second waveform to the second pressure generating unit; and a controller that controls the application unit to generate a waveform which includes at least one of a third waveform or a fourth waveform as the second waveform and to apply the waveform to the second pressure generating unit, the third waveform being set in advance according to a jetting angle from a reference jetting direction in order to change a liquid droplet jetting direction from the reference jetting direction to the predetermined direction by deforming the liquid level of liquid pulled inside the nozzle in a direction of pushing the liquid level outside the nozzle, and the fourth waveform being set in advance according to a jetting angle from the reference jetting direction in order to change the liquid droplet jetting direction from the reference jetting direction to the predetermined direction by deforming the liquid level of liquid pulled inside the nozzle in a direction of further pulling the liquid level inside the nozzle, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, the controller controls the application unit such that expression (1) is satisfied, $$T0-Tx/4 \leqq tc < T0+Tx/2 \quad (1).$$

2. The driving device according to claim 1, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, the controller controls the application unit such that expression (2) is satisfied, $$T0-Tx/8 \leqq tc \leqq T0+Tx/5 \quad (2).$$

3. The driving device according to claim 1, wherein assuming that a start time of the first waveform corresponding to start of an operation of pulling liquid inside the nozzle is T0, a natural period of a pressure elastic wave of the first pressure chamber is Tx, and a phase difference between the first and second waveforms is tc, the controller controls the application unit such that expression (3) is satisfied, $$T0-Tx/6 \leqq tc < T0+Tx/2 \quad (3).$$

4. The driving device according to claim 1, wherein the controller controls the application unit such that at least one of a voltage of a waveform in which the voltage is set in advance corresponding to the jetting angle, or a voltage of a waveform in which a phase difference from the first waveform is set in advance corresponding to the jetting angle, is applied to the second pressure generating unit as the second voltage of the second waveform.

5. A liquid droplet jetting device comprising:

a nozzle from which a liquid droplet is jetted;

a plurality of pressure chambers that includes first and second pressure chambers disposed along a predetermined direction with respect to the nozzle;

a first pressure generating unit that is provided corresponding to the first pressure chamber and that generates pressure for jetting a liquid droplet outside the nozzle after pulling the liquid inside the nozzle when a first voltage of a predetermined first waveform for jetting the liquid droplet outside the nozzle after pulling the liquid inside the nozzle is applied;

a second pressure generating unit that is provided corresponding to the second pressure chamber and that generates pressure for deforming a liquid level of the liquid pulled inside the nozzle by applying the first voltage when a second voltage of a second waveform, whose voltage value is smaller than that of the first waveform, for deforming the liquid level of the liquid pulled inside the nozzle by applying the first voltage to the first pressure generating unit is applied; and a driving device for the liquid droplet jetting device that comprises an application unit that generates the first voltage of the first waveform and applies the first voltage of the first waveform to the first pressure generating unit, and generates the second voltage of the second waveform and applies the second voltage of the second waveform to the second pressure generating unit; and a controller that controls the application unit to generate a waveform which includes at least one of a third waveform or a fourth waveform as the second waveform and to apply the waveform to the second pressure generating unit, the third waveform being set in advance according to a jetting angle from a reference jetting direction in order to change a liquid droplet jetting direction from the reference jetting direction to the predetermined direction by deforming the liquid level of liquid pulled inside the nozzle in a direction of pushing the liquid level outside the nozzle, and the fourth waveform being set in advance according to a jetting angle from the reference jetting direction in order to change the liquid droplet jetting direction from the reference jetting direction to the predetermined direction by deforming the liquid level of liquid pulled inside the nozzle in a direction of further pulling the liquid level inside the nozzle, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, the controller controls the application unit such that expression (1) is satisfied, $$T0-Tx/4 \leqq tc < T0+Tx/2 \quad (1).$$

6. The liquid droplet jetting device according to claim 5, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, the controller controls the application unit such that expression (2) is satisfied, $$T0-Tx/8 \leqq tc \leqq T0+Tx/5 \quad (2).$$

7. The liquid droplet jetting device according to claim 5, wherein assuming that a start time of the first waveform corresponding to start of an operation of pulling liquid inside the nozzle is T0, a natural period of a pressure elastic wave of the first pressure chamber is Tx, and a phase difference between the first and second waveforms is tc, the controller controls the application unit such that expression (3) is satisfied, $$T0-Tx/6 \leqq tc < T0+Tx/2 \quad (3).$$

8. The liquid droplet jetting device according to claim 5, wherein the controller controls the application unit such that at least one of a voltage of a waveform in which the voltage is set in advance corresponding to the jetting angle, or a voltage of a waveform in which a phase difference from the first waveform is set in advance corresponding to the jetting angle, is applied to the second pressure generating unit as the second voltage of the second waveform.

9. An image forming apparatus comprising:

a liquid droplet jetting device that comprises a nozzle from which a liquid droplet is jetted;

a plurality of pressure chambers that includes first and second pressure chambers disposed along a predetermined direction with respect to the nozzle;

a first pressure generating unit that is provided corresponding to the first pressure chamber and that generates pressure for jetting a liquid droplet outside the nozzle after pulling the liquid inside the nozzle when a first voltage of a predetermined first waveform for jetting the liquid droplet outside the nozzle after pulling the liquid inside the nozzle is applied; and a second pressure generating unit that is provided corresponding to the second pressure chamber and that generates pressure for deforming a liquid level of the liquid pulled inside the nozzle by applying the first voltage when a second voltage of a second waveform, whose voltage value is smaller than that of the first waveform, for deforming the liquid level of the liquid pulled inside the nozzle by applying the first voltage to the first pressure generating unit is applied; and a driving device for the liquid droplet jetting device that comprises an application unit that generates the first voltage of the first waveform and applies the first voltage of the first waveform to the first pressure generating unit and that generates the second voltage of the second waveform and applies the second voltage of the second waveform to the second pressure generating unit, and a controller that controls the application unit to generate a waveform which includes at least one of a third waveform or a fourth waveform as the second waveform and to apply the waveform to the second pressure generating unit, the third waveform being set in advance according to a jetting angle from a reference jetting direction in order to change the liquid droplet jetting direction from the reference jetting direction to the predetermined direction by deforming a liquid level of liquid pulled inside the nozzle in a direction of pushing the liquid level outside the nozzle, and the fourth waveform being set in advance according to a jetting angle from the reference jetting direction in order to change the liquid droplet jetting direction from the reference jetting direction to the predetermined direction by deforming the liquid level of liquid pulled inside the nozzle in a direction of further pulling the liquid level inside the nozzle, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, the controller controls the application unit such that expression (1) is satisfied, $$T0-Tx/4 \leqq tc < T0+Tx/2 \quad (1).$$

10. The image forming apparatus according to claim 9, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, the controller controls the application unit such that expression (2) is satisfied, $$T0-Tx/8 \leqq tc \leqq T0+Tx/5 \quad (2).$$

11. The image forming apparatus according to claim 9, wherein assuming that a start time of the first waveform corresponding to start of an operation of pulling liquid inside the nozzle is T0, a natural period of a pressure elastic wave of the first pressure chamber is Tx, and a phase difference between the first and second waveforms is tc, the controller controls the application unit such that expression (3) is satisfied, $$T0-Tx/6 \leqq tc < T0+Tx/2 \quad (3).$$

12. The image forming apparatus according to claim 9, wherein the controller controls the application unit such that at least one of a voltage of a waveform in which the voltage is set in advance corresponding to the jetting angle, or a voltage of a waveform in which a phase difference from the first waveform is set in advance corresponding to the jetting angle, is applied to the second pressure generating unit as the second voltage of the second waveform.

13. A non-transitory computer readable medium storing a program causing a computer to execute a process for driving a driving device for a liquid droplet jetting device, the liquid droplet jetting device including a nozzle from which a liquid droplet is jetted, a plurality of pressure chambers which includes first and second pressure chambers disposed along a predetermined direction with respect to the nozzle, a first pressure generating unit that is provided corresponding to the first pressure chamber and that generates pressure for jetting a liquid droplet outside the nozzle after pulling the liquid inside the nozzle when a first voltage of a predetermined first waveform for jetting the liquid droplet outside the nozzle after pulling liquid inside the nozzle is applied, and a second pressure generating unit that is provided corresponding to the second pressure chamber and that generates pressure for deforming a liquid level of the liquid pulled inside the nozzle by applying the first voltage when a second voltage of a second waveform, whose voltage value is smaller than that of the first waveform, for deforming the liquid level of the liquid pulled inside the nozzle by applying the first voltage to the first pressure generating unit is applied, the process for driving the driving device comprising:

generating the first voltage of the first waveform and applying the first voltage of the first waveform to the first pressure generating unit; and generating the second voltage of the second waveform and applying the second voltage of the second waveform to the second pressure generating unit, the second waveform including at least one of a third waveform or a fourth waveform, the third waveform being set in advance according to a jetting angle from a reference jetting direction in order to change a liquid droplet jetting direction from the reference jetting direction to the predetermined direction by deforming the liquid level of liquid pulled inside the nozzle in a direction of pushing the liquid level outside the nozzle, and the fourth waveform being set in advance according to a jetting angle from the reference jetting direction in order to change the liquid droplet jetting direction from the reference jetting direction to the predetermined direction by deforming the liquid level of liquid pulled inside the nozzle in a direction of further pulling the liquid level inside the nozzle, wherein assuming that a start time of the first waveform corresponding to a start of an operation of pulling liquid inside the nozzle is T0, a natural period of a pressure elastic wave of the first pressure chamber is Tx, and a phase difference between the first and second waveforms is tc, expression (1) is satisfied, $$T0-Tx/4 \leqq tc < T0+Tx/2 \quad (1).$$

14. The non-transitory computer readable medium according to claim 13, wherein assuming that a start time of the first waveform corresponding to start of an operation of pulling liquid inside the nozzle is T0, a natural period of a pressure elastic wave of the first pressure chamber is Tx, and a phase difference between the first and second waveforms is tc, expression (2) is satisfied, $$T0-Tx/8 \leqq tc \leqq T0+Tx/5 \quad (2).$$

15. The non-transitory computer readable medium according to claim 13, wherein assuming that a start time of the first waveform corresponding to start of an operation of pulling liquid inside the nozzle is T0, a natural period of a pressure elastic wave of the first pressure chamber is Tx, and a phase difference between the first and second waveforms is tc, expression (3) is satisfied, $$T0-Tx/6 \leqq tc < T0+Tx/2 \quad (3).$$

16. The non-transitory computer readable medium according to claim 13, wherein applying the second voltage of the second waveform to the second pressure generating unit further comprises applying as the second waveform at least one of a voltage of a waveform in which the voltage is set in advance corresponding to the jetting angle, or a voltage of a waveform in which a phase difference from the first waveform is set in advance corresponding to the jetting angle.

* * * * *